US008196312B2

(12) United States Patent
Taguchi

(10) Patent No.: US 8,196,312 B2
(45) Date of Patent: Jun. 12, 2012

(54) DRYING METHOD AND APPARATUS FOR DRYING OBJECT

(75) Inventor: Takao Taguchi, Haibara-gun (JP)

(73) Assignee: FUJIFILM Corporation, Tokyo (JP)

( * ) Notice: Subject to any disclaimer, the term of this patent is extended or adjusted under 35 U.S.C. 154(b) by 1013 days.

(21) Appl. No.: 12/160,022

(22) PCT Filed: May 18, 2007

(86) PCT No.: PCT/JP2007/060262

§ 371 (c)(1),
(2), (4) Date: Jul. 3, 2008

(87) PCT Pub. No.: WO2007/136005

PCT Pub. Date: Nov. 29, 2007

(65) Prior Publication Data

US 2010/0058609 A1 Mar. 11, 2010

(30) Foreign Application Priority Data

May 18, 2006 (JP) ..... 2006-138810

(51) Int. Cl.
*F26B 7/00* (2006.01)

(52) U.S. Cl. ..... 34/443; 34/497; 34/69; 34/201; 118/65; 118/67; 134/10; 134/108; 427/378; 159/7; 159/8

(58) Field of Classification Search ..... 34/423, 34/443, 497, 69, 78, 80, 201, 218; 118/65, 118/67; 134/10, 108; 427/378; 159/7, 8
See application file for complete search history.

(56) References Cited

U.S. PATENT DOCUMENTS 3,757,427 A * 9/1973 Wilkinson ..... 34/479
4,106,209 A * 8/1978 Brown ..... 34/339
5,940,985 A * 8/1999 Kamikawa et al. ..... 34/471

(Continued)

FOREIGN PATENT DOCUMENTS

EP 1 462 746 A2 9/2004

(Continued)

OTHER PUBLICATIONS

International Preliminary Report on Patentability and Written Opinion, dated Dec. 24, 2008, issued in corresponding application PCT/JP2007/060262, 5 pages.

*Primary Examiner* — Stephen M. Gravini
(74) *Attorney, Agent, or Firm* — Sughrue Mion, PLLC

(57) ABSTRACT

A technology can efficiently dry the high-boiling point solvent contained in the object and achieve the space-saving and energy-saving of a drying apparatus. A drying method for drying an object containing a first solvent while conveying the object into a chamber (38), comprises: a first drying step of drying the object up to a drying point in the prestage of the chamber (38); and a second drying step of forming a vapor atmosphere of a second solvent having a lower boiling point than the first solvent in the chamber (38) and drying the object such that the temperature of the object in an inlet port of the chamber (38) is made to be lower by a predetermined temperature difference than the temperature of the vapor atmosphere.

18 Claims, 8 Drawing Sheets

U.S. PATENT DOCUMENTS

| | | | | |
|---|---|---|---|---|
| 6,834,440 | B2 * | 12/2004 | Lee | 34/58 |
| 7,437,834 | B2 * | 10/2008 | Nakatsukasa et al. | 34/381 |
| 2004/0191419 | A1 | 9/2004 | Oki et al. | |
| 2007/0075449 | A1 * | 4/2007 | Nagashima | 264/1.6 |
| 2010/0058609 | A1 * | 3/2010 | Taguchi | 34/443 |
| 2010/0105830 | A1 * | 4/2010 | Kaneko | 524/599 |
| 2010/0148392 | A1 * | 6/2010 | Tonohara | 264/212 |
| 2010/0325913 | A1 * | 12/2010 | Wang et al. | 34/423 |
| 2011/0157524 | A1 * | 6/2011 | Kawanishi et al. | 349/96 |

FOREIGN PATENT DOCUMENTS

| | | | |
|---|---|---|---|
| EP | 1967803 | A1 * | 9/2008 |
| JP | 9-502252 | A | 3/1997 |
| JP | 2000-158814 | A | 6/2000 |
| JP | 2000-516334 | A | 12/2000 |
| JP | 2002-067520 | A | 3/2002 |
| JP | 2002-333275 | A | 11/2002 |
| JP | 2002-367950 | A | 12/2002 |
| JP | 2004-290776 | A | 10/2004 |
| WO | WO 2007136005 | A1 * | 11/2007 |

* cited by examiner

FIG.6

TABLE 1

| | HOT AIR DRYING | | VAPOR ATMOSPHERE DRYING | | | | | | | REMAINING γ-BUTYROLACTONE AMOUNT (mg/m²) |
|---|---|---|---|---|---|---|---|---|---|---|
| | DRYING TEMPERATURE (°C) | DRYING TIME (SEC) | SOLVENT | VAPOR TEMPERATURE (°C) | VAPOR AMOUNT C (g/m³) | TEMPERATURE OF THE WEB 12 IN THE INLET PORT (°C) | TEMPERATURE OF THE WEB 12 IN THE OUTLET PORT (°C) | MAXIMUM ACHIEVING TEMPERATURE OF THE WEB 12 (°C) | TEMPERATURE DIFFERENCE ΔT (°C) | |
| EXAMPLE 1-1 | 120 | 30 | WATER | 140 | 300 | 85 | 86.5 | 90 | 55 | 19 |
| EXAMPLE 1-2 | 120 | 30 | MEK | 110 | 400 | 85 | 86 | 89 | 25 | 10 |
| COMPARATIVE EXAMPLE 1-1 | 180 | 60 | – | – | – | – | – | 178 | – | 20 |

FIG.7

TABLE 2

| | HOT AIR DRYING | | VAPOR ATMOSPHERE DRYING | | | | REMAINING γ-BUTYROLACTONE AMOUNT (mg/m²) | DEW CONDENSATION |
|---|---|---|---|---|---|---|---|---|
| | DRYING TEMPERATURE (°C) | DRYING TIME (SEC) | VAPOR TEMPERATURE (°C) | VAPOR AMOUNT C (g/m³) | TEMPERATURE OF THE WEB 12 (°C) | TEMPERATURE DIFFERENCE ΔT (°C) | | |
| EXAMPLE 2-1 | 160 | 33 | 140 | 300 | 135 | 5 | 45 | ABSENT |
| EXAMPLE 2-2 | 105 | 45 | 140 | 300 | 100 | 40 | 28 | ABSENT |
| EXAMPLE 2-3 | 90 | 55 | 140 | 300 | 85 | 55 | 19 | ABSENT |
| EXAMPLE 2-4 | 60 | 90 | 140 | 300 | 60 | 80 | 11 | PRESENT |
| EXAMPLE 2-5 | 40 | 120 | 140 | 300 | 40 | 100 | 10 | PRESENT |
| EXAMPLE 2-6 | 30 | 200 | 140 | 300 | 30 | 110 | 10 | PRESENT |
| COMPARATIVE EXAMPLE 2-1 | 160 | 30 | 140 | 300 | 140 | 0 | 64 | ABSENT |
| COMPARATIVE EXAMPLE 2-2 | 175 | 25 | 140 | 300 | 150 | -10 | 65 | ABSENT |
| COMPARATIVE EXAMPLE 2-3 | 160 | 30 | 140 | 100 | 140 | 0 | 93 | ABSENT |
| COMPARATIVE EXAMPLE 2-4 | 160 | 31.5 | – | – | – | – | 92 | – |
| COMPARATIVE EXAMPLE 2-5 | 160 | 60 | – | – | – | – | 36 | – |
| COMPARATIVE EXAMPLE 2-6 | 160 | 170 | – | – | – | – | 10 | – |

DRYING METHOD AND APPARATUS FOR DRYING OBJECT

CROSS REFERENCE TO RELATED APPLICATION

This application is a National Stage of International Application No. PCT/JP2007/060262 filed on May 18, 2007, claiming priority based on Japanese Patent Application No. 2006-138810, filed May 18, 2006, the contents of all of which are incorporated herein by reference in their entirety.

TECHNICAL FIELD

The present invention relates to a drying method and apparatus for drying an object, particularly to a drying method and apparatus which can efficiently dry an object containing a high-boiling point solvent to remove the solvent.

BACKGROUND ART

Magnetic recording materials such as lithographic printing plates, various optical films, silver halide films, photographic papers and base films of videotapes are manufactured by applying and drying a coating liquid, such as a photosensitive layer forming liquid or thermosensitive layer forming liquid, a photosensitive emulsion or a magnetic layer forming liquid, on a beltlike body such as a supporter web, a base film or a baryta paper, while the beltlike body is made to travel in a certain direction, and thereafter, by cutting the beltlike body into a predetermined size as required.

In such a process, drying and removing precisely a solvent contained in the coating liquid is said to be preferable in view of quality of products.

Conventional drying techniques generally involve methods using dry hot air. Besides, various drying methods using hot air containing a solvent vapor are proposed.

For example, Patent Document 1 proposes an apparatus for continuously drying an object containing moisture by using superheated steam. Patent Document 2 proposes an apparatus to dry and process food by using superheated steam.

Patent Documents 3 and 4 propose vapor driers to precisely remove water droplets and other contaminants from device parts by using a combustible solvent vapor such as isopropyl alcohol or an equivalent low-firing point solvent.

Patent Document 5 describes a method proposed using a theoretical analysis by Vrentas et al. as a removing method of a residual solvent in a coated film (J. Appl. Polym. Sci., 30, 4499 (1985)). Vrentas et al. cite that factors making it difficult to remove a high-boiling point solvent and the like remaining in a polymeric resin involve that the diffusion coefficient of the solvent in the polymeric resin sharply decreases as the amount of the solvent remaining in the polymeric resin decreases and that the diffusion coefficient of the solvent in the polymeric resin becomes smaller as a size (molecular volume) of the solvent molecule itself becomes larger. Hence, Vrentas et al. propose, for a polymeric resin film in which a trace amount of a high-boiling point solvent remains: 1) to expose the film to a solvent vapor having a smaller molecular volume than the high-boiling point solvent and heat it; and 2) to take out the film from a second solvent vapor atmosphere and heat it.

Patent Document 1: Japanese National Publication of International Patent Application No. 9-502252

Patent Document 2: Japanese Patent Application Laid-Open No. 2002-333275

Patent Document 3: Japanese National Publication of International Patent Application No. 2000-516334

Patent Document 4: Japanese Patent Application Laid-Open No. 2002-367950

Patent Document 5: Japanese Patent Application Laid-Open No. 2000-158814

DISCLOSURE OF THE INVENTION

Problems to be Solved by the Invention

However, the above-mentioned conventional hot air drying requires drying over a long time by a high-temperature hot air for evaporating and drying a high-boiling point solvent contained in an object, and hence has a problem of possibly causing the quality deterioration and thermal decomposition of the object. Further, when an object which is a belt-like supporter continuously traveling is dried, the method requires larger devices, which is also a problem.

In addition, the above-mentioned conventional drying methods using hot air containing a solvent vapor as in Patent Documents 1 and 2 do not clearly specify the temperature and the vapor amount (concentration) of an superheated steam to be used, and do not consider the condensation of the steam onto the surface of an object to be dried. Hence, condensation of steam onto an object to be dried becomes a factor of decreasing a function of the object such as a functional material. Besides, the efficiency of drying for removal is not sufficient.

Additionally, the method described in Patent Document 5 alone provides still insufficient drying, and further cannot sufficiently reduce drying energy as a total.

Thus, various technical fields have problems of efficiently drying and removing a high-boiling point solvent in an object without decreasing the performances of the object, and achieving the space-saving and energy-saving of a drying apparatus.

The present invention has been achieved in consideration of such situations, and has an object to provide a drying method and apparatus which can efficiently dry particularly a high-boiling point solvent contained in an object to be dried and can achieve space-saving and energy-saving of a drying apparatus.

Means for Solving the Problems

For achieving the above-mentioned object, according to a first aspect of the present invention, a drying method for drying an object containing a first solvent while conveying the object, the drying method comprises: a first drying step of drying the object up to a drying point; and a second drying step of forming, in a drying chamber at a post stage of the first drying step, a vapor atmosphere of a second solvent having a lower boiling point than the first solvent and drying the object such that the temperature of the object in an inlet port of the drying chamber is made to be lower by a predetermined temperature difference than the temperature of the vapor atmosphere.

The inventor has found that when an object containing a first solvent is dried, after the object is dried up to a drying point, not drying simply by heating, but drying by heating the object in a vapor atmosphere of a second solvent having a lower boiling point than the first solvent can dry and remove the first solvent in a lower temperature state of the object and in a shorter time, i.e. more efficiently, than those of conventional method (no vapor of the second solvent). As a drying method for drying an object up to a drying point, hot air drying can suitably be used.

Describing the case where an object is a coated film, the drying rate slows down in the falling drying rate period after the coated film has solidified to some degree. In the falling drying rate period, if a coated film is dried in a vapor atmosphere of a solvent having a lower-boiling point than a solvent contained in the object, the free volume in the coated film is increased and the drying rate can be improved. By contrast, in the constant drying rate period before the coated film solidifies to some degree, since the free volume does not exist in the coated film, drying in a solvent vapor atmosphere only condenses the vapor in the coated film, and cannot improve the drying rate.

According to the first aspect of the present invention, since a first drying step of drying an object up to a drying point at a prestage of a drying chamber and a second drying step of forming a vapor atmosphere of a second solvent having a lower boiling point than the first solvent and drying the object such that the temperature of the object in an inlet port of the drying chamber is made to be lower by a predetermined temperature difference than the temperature of the vapor atmosphere therein are carried out, the first solvent contained in the object can be dried and removed at a relatively low temperature and in a short time.

Therefore, according to the first aspect of the present invention, a high-boiling point solvent contained in an object can be efficiently dried with a small amount of thermal energy, thereby achieving the space-saving and energy-saving of a drying apparatus.

Here, "drying point" refers to a point in the drying step having reached a drying state where no more change in the surface glossiness of an object coated with a coating liquid is observed. Specifically, it refers to a critical point where the constant drying rate period transits to the falling drying rate period, and a point where the solid content ratio enters the range of 70 to 90%.

According to a second aspect of the present invention, the temperature difference in the drying method according to the first aspect is in a range of 5 to 100° C.

According to the second aspect, since the above-mentioned temperature difference is in the range of 5 to 100° C., a high-boiling point solvent contained in the object can easily be vaporized. Therefore, the high-boiling point solvent contained in the object can be efficiently dried with a small amount of thermal energy. Here, the temperature difference is more preferably in a range of 20 to 60° C.

According to a third aspect of the present invention, the drying method according to the first or second aspects satisfies $0.25 \leqq CR(273.15+T)/(P_T \times M) < 1.0$, where a vapor amount of the second solvent is denoted as C [g/m$^3$]; a temperature of the object is denoted as T [° C.]; a saturated vapor pressure of the second solvent at T° C. is denoted as $P_T$[Pa]; a molecular weight of the second solvent is denoted as M; and the gas constant is denoted as R (8.31 Pa·m$^3$/(mol·K)).

According to the third aspect, since a vapor amount C of the second solvent is in the range of the above expression, dew condensation of the second solvent on the object can be suppressed and a vapor atmosphere can improve the drying efficiency.

According to a fourth aspect of the present invention, the drying method according to any one of the first to third aspects further comprises: a temperature detecting step of detecting a temperature of the vapor atmosphere of the second solvent and a temperature of the object; and a temperature controlling step of controlling the temperature of the object and/or the temperature of the vapor atmosphere of the second solvent such that the temperature of the object is lower by a predetermined temperature difference than the temperature of the vapor atmosphere, based on the detected results obtained by the temperature detecting step.

According to the fourth aspect, in the drying chamber, a temperature of the object can be stably maintained such that the temperature of the object is lower by a predetermined temperature difference than a temperature of the vapor atmosphere of the second solvent. Therefore, a high-boiling point solvent contained in an object can be efficiently dried with a small amount of thermal energy, thereby achieving the space-saving and energy-saving of a drying apparatus.

According to a fifth aspect of the present invention, the drying method according to any one of first to fourth aspects further comprises: a vapor amount detecting step of detecting a vapor amount of the second solvent in the drying chamber to form a vapor atmosphere of the second solvent; and a vapor amount controlling step of controlling the vapor amount of the second solvent supplied to the drying chamber such that the vapor amount of the second solvent in the drying chamber is in a predetermined range, based on the detected result obtained by the vapor amount detecting step.

According to the fifth aspect, since a vapor amount of the second solvent in the drying chamber can be stably maintained in a predetermined range, a high-boiling point solvent contained in the object can be efficiently dried. Here, the predetermined range includes a range according to the third aspect.

According to a sixth aspect of the present invention, the drying method of an object according to any one of the first to fifth aspects is applied to a manufacturing method of a lithographic printing plate precursor.

According to the sixth aspect, when an imaging layer and the like of a lithographic printing plate precursor are dried, a high-boiling point solvent in the imaging layer can be efficiently dried and removed and a lithographic printing plate having a favorable quality performance can be provided. This drying method can be applied not only to a drying process of an imaging layer, but also to other drying processes.

For achieving the above-mentioned object, according to a seventh aspect of the present invention, a drying apparatus for drying an object containing a first solvent while conveying the object, the drying apparatus comprises: a first drying section to dry the object up to a drying point; and a second drying section to form a vapor atmosphere of a second solvent having a lower boiling point than the first solvent in a drying chamber provided at a post stage of the first drying section and to dry the object such that the temperature of the object in an inlet port of the drying chamber is made to be lower by a predetermined temperature difference than a temperature of the vapor atmosphere.

The seventh aspect is constituted as an apparatus of the present invention. In the seventh aspect, the "drying point" in the first drying section refers to a point having reached a drying state where no more change in the surface glossiness of an object coated with a coating liquid is observed. Specifically, it refers to a critical point where the constant drying rate period transits to the falling drying rate period, and a point where the solid content ratio enters a range of 70 to 90%.

According to an eighth aspect of the present invention, the second drying section of the drying apparatus according to the seventh aspect further comprises: a solvent vapor generating device to generate a second solvent having a lower boiling point than the first solvent and to form a vapor atmosphere of the second solvent in the drying chamber; a heating device to heat the object in the drying chamber; a temperature detecting device to detect a temperature of the vapor atmosphere of the second solvent and a temperature of the object in an inlet port of the drying chamber; and a controlling device to control the heating device such that the temperature of the object in the inlet port of the drying chamber is lower by a predetermined temperature difference than the temperature of the vapor atmosphere based on the detected results obtained by the temperature detecting device.

According to the eighth aspect, a high-boiling point solvent contained in the object can be efficiently dried with a small amount of thermal energy, and the space-saving and energy-saving of a drying apparatus can be achieved. Here, the heating device include heated air, radiant heat transfer (for example, halogen heater, infrared heater and microwave), induction heat transfer and a combination thereof.

According to a ninth aspect of the present invention, the drying apparatus according to the eighth aspect further comprises a cooling device to cool the object at the prestage of the drying chamber and the control device controls the cooling device such that the temperature of the object in the inlet port of the drying chamber is lower by a predetermined temperature difference than the temperature of the vapor atmosphere based on the detected results obtained by the temperature detecting device.

According to the ninth aspect, the object can be cooled in advance such that the temperature of the object in the inlet port of the drying chamber is lower by a predetermined temperature difference than the temperature of the vapor atmosphere. Such a cooling device may include a cooling device using cool air and a device using heat exchange with a coolant.

According to a tenth aspect of the present invention, the drying apparatus according to the eighth or the ninth aspect further comprises: a vapor amount detecting device to detect a vapor amount of the second solvent in the drying chamber; and a vapor amount controlling device to control the vapor amount of the second solvent supplied to the drying chamber such that the vapor amount of the second solvent in the drying chamber is in a predetermined range, based on the detected result obtained by the vapor amount detecting device.

According to the tenth aspect, since a vapor amount of the second solvent in the drying chamber can be stably maintained in a predetermined range, a high-boiling point solvent contained in an object can be efficiently dried with a small amount of heat energy. Here, the predetermined range involves a range where the second solvent does not condense on the object.

According to an eleventh aspect of the present invention, the drying apparatus according to any one of the eighth to tenth aspects further comprises an air curtain forming device to form air curtains in the inlet port and the outlet port of the drying chamber.

According to the eighth aspect, leakage of the second solvent vapor outside the drying chamber and invasion of air from outside the drying chamber can be suppressed and various conditions such as the temperature of the vapor atmosphere and the vapor amount in the accommodating chamber can be stably maintained. Therefore, a high-boiling point solvent contained in the object can efficiently be dried. Here, the air curtain is preferably formed by making clean air to flow in a direction (width direction) perpendicular to a conveying direction of the object.

According to a twelfth aspect of the present invention, the drying apparatus according to any one of the eighth to eleventh aspects further comprises: a solvent storing tank to store the second solvent to be supplied to the solvent vapor generating device; a separating device to separate the second solvent from the vapor atmosphere exhausted from the drying chamber; and a circulating pipe to return the second solvent separated in the separating device to the solvent storing tank.

According to the twelfth aspect, the second solvent used in the drying chamber can be recycled and a high-boiling point solvent contained in the object can be efficiently dried with a small amount of heat energy. Here, the separating device to be used includes, for example, a device to separate a solvent obtained by condensing a recovered vapor using a distillation column or the like.

According to a thirteenth aspect of the present invention, the drying apparatus according to any one of the seventh to twelfth aspects further comprises a third drying section to dry by hot air the object at a post stage of the second drying section.

According to the thirteenth aspect, the high-boiling point solvent contained in the object can be efficiently in multiply staged drying conditions and the space-saving and energy-saving of a drying apparatus can be achieved.

According to a fourteenth aspect of the present invention, a manufacturing apparatus of a lithographic printing plate precursor comprises the drying apparatus for drying an object according to any one of the seventh to thirteenth aspects.

According to the fourteenth aspect, a lithographic printing plate having a favorable quality performance can be provided.

According to the aspects of the present invention, particularly a high-boiling point solvent contained in an object can be efficiently dried and the space-saving and energy-saving of a drying apparatus can be achieved.

BRIEF DESCRIPTION OF THE DRAWINGS

FIG. 6 is a table showing results of the Examples;

FIG. 7 is a table showing results of the Examples; and

DESCRIPTION OF SYMBOLS

10 . . . manufacturing apparatus of a lithographic printing plate precursor, 12 . . . web, 14 . . . surface treating apparatus, 16 . . . first coating apparatus (imaging layer), 20 . . . drying apparatus, 22 . . . second coating apparatus (overcoat layer), 24 . . . drying apparatus, 30 . . . vapor atmosphere drying section (second drying section), 32 . . . hot air drying section (first drying section), 34 . . . hot air drying section (third drying section), 40 . . . nozzle (for hot air), 42 . . . nozzle (for solvent vapor), 36 . . . drying box, 38 . . . chamber, 44 . . . air curtain forming device, 50, 60 . . . pipe, 64 . . . circulating pipe, 48 . . . first heat exchanger, 52 . . . second heat exchanger, 53 . . . third heat exchanger, 46 . . . blower, 54 . . . solvent tank, 56 . . . low-boiling point solvent, 62 . . . distillation column, 68 . . . temperature detecting device, 70 . . . controlling device, 72 . . . vapor amount detecting device, 74 . . . vapor amount controlling device, 76 . . . valve

BEST MODE FOR CARRYING OUT THE INVENTION

Hereinafter, the preferable embodiment of the drying method and apparatus for drying an object according to the present invention will be described referring to the accompanying drawings. In the embodiment, a drying apparatus to evaporate and dry a refractory solvent contained in an imaging layer coated film in a manufacturing apparatus of a lithographic printing plate precursor will be illustrated, but the scope of the present invention is not limited to this technical field and it is therefore to be understood that the present invention is applicable to drying methods and apparatuses for drying objects in various technical fields.

First, a basic configuration of the manufacturing apparatus 10 of a lithographic printing plate precursor of the present invention will be described.

Figure 1:
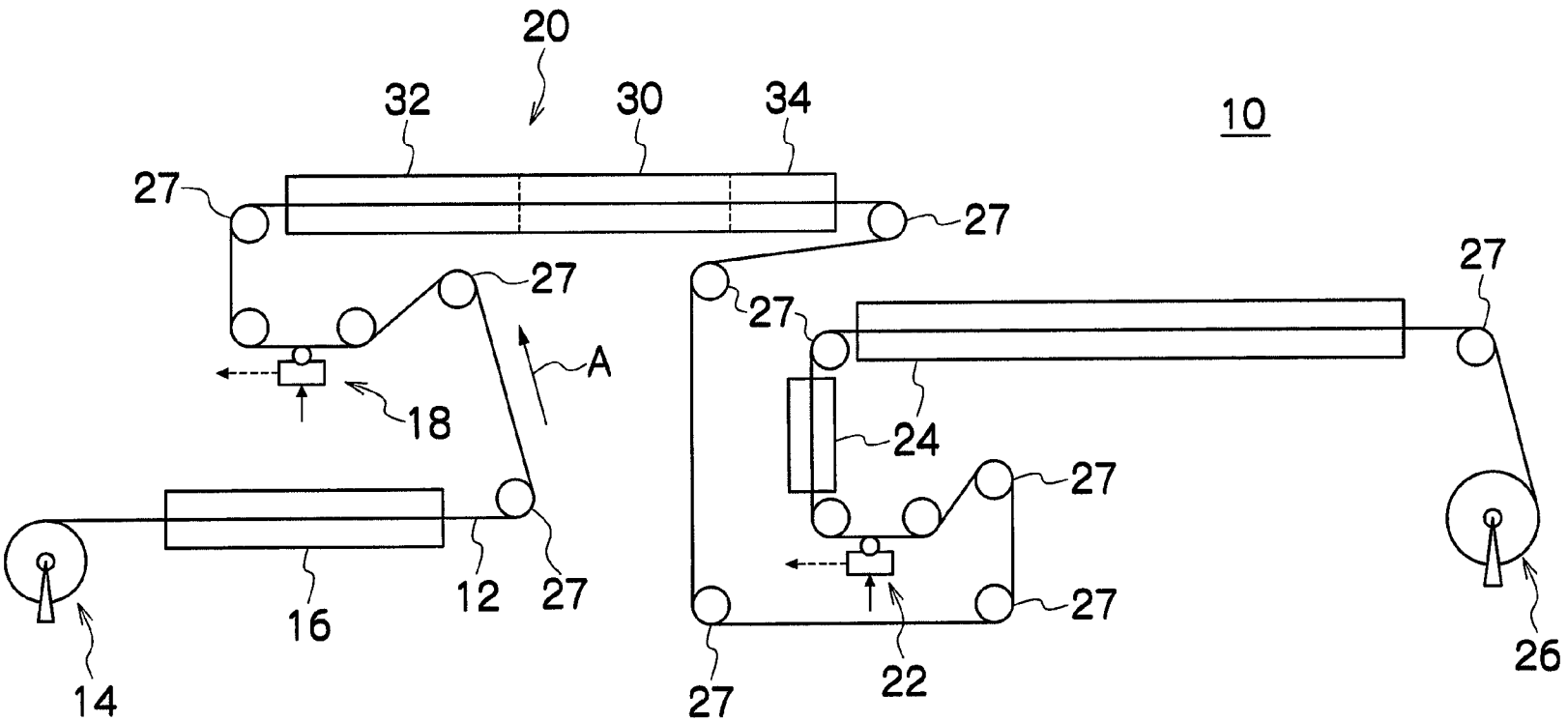
FIG. 1 is a diagram illustrating an example of a configuration of a manufacturing apparatus of a lithographic printing plate precursor in the embodiment.

FIG. 1 is a diagram showing a basic configuration of the manufacturing apparatus 10 of a lithographic printing plate precursor in the embodiment. In FIG. 1, an arrow A denotes the conveying direction of a supporter (hereinafter, referred to as web 12).

The manufacturing apparatus 10 of a lithographic printing plate precursor in FIG. 1 mainly comprises: a delivery apparatus 14 to deliver a web 12; a surface treating apparatus 16 to treat a coating surface of the web 12; a first coating apparatus 18 to coat an imaging layer coating liquid; a drying apparatus 20 to dry the coated imaging layer; a second coating apparatus 22 to coat an overcoat layer on the imaging layer; a drying apparatus 24 to dry the overcoat layer; and a taking-up apparatus 26 to take up the web 12. Here, the manufacturing apparatus 10 of a lithographic printing plate precursor shown in FIG. 1 is an example, and for example, a coating apparatus to coat an undercoat coating liquid may be provided before the imaging layer coating liquid is coated, or a humidity conditioning apparatus to condition the moisture of overcoat layer may be provided after the drying apparatus 24 of the overcoat layer.

The web 12 delivered from the delivery apparatus 14 is guided and conveyed through guide rollers 27 . . . and the like to each process.

First, in the surface treating apparatus 16, the web 12 is subjected to necessary pretreatments including, for example, a degreasing treatment and a surface-roughening treatment (graining treatment, etc.) to roughen the surface of the web 12 for making a favorable adhesiveness of the web 12 with the imaging layer and imparting the moisture retentivity to non-image parts, an anodizing treatment (alumite treatment) to form an oxidized film on the surface for improving the wear resistance, chemicals resistance and moisture retentivity of the web 12, and a silicate treatment for improving the film strength and hydrophilicity of the anodized film (alumite film) and the adhesiveness thereof with the imaging layer.

The coating apparatus 18 is an apparatus to coat the imaging layer coating liquid on the surface of the web 12. The coating method to be used includes, for example, slide bead coating, curtain coating, bar coating, spin coating, spray coating, dip coating, air knife coating, blade coating and roll coating. The method is not especially limited thereto, but among them, slide bead coating, curtain coating, bar coating and the like are preferably used. In FIG. 1, the coating method is shown as bar coating.

The drying apparatus 20 is an apparatus to dry the imaging layer formed on the web 12, and comprises a vapor atmosphere drying section 30 (second drying section) according to the present invention, and a hot air drying section 32 (first drying section) and a hot air drying section 34 (third drying section) according to the present invention at the prestage and the post stage of the vapor atmosphere drying section 30, respectively. Here, the imaging layer coated film contains a refractory high-boiling point solvent as a first solvent and it is important in view of the quality of a lithographic printing plate precursor that the first solvent (hereinafter, referred to as a high-boiling point solvent) is efficiently vaporized and dried. The detailed configuration of the drying apparatus 20 will be described later because it is the characteristic part of the present invention.

The second coating apparatus 22 is an apparatus to form a water-soluble overcoat layer on the imaging layer for blocking oxygen to the imaging layer and preventing contamination of the imaging layer surface by a lipophilic substance. The water-soluble overcoat layer can be easily removed at printing, and contains a resin selected from water-soluble organic polymeric compounds. As a coating method of the water-soluble overcoat layer, an apparatus similar to the above-mentioned first coating apparatus 18 can be used. The web 14 coated with the water-soluble overcoat layer is further dried in the post stage drying apparatus 24, and thereafter, finally taken up by the taking-up apparatus 26.

Then, an example of a configuration of the drying apparatus 20, which is the characteristic part of the present invention, will be described.

Figure 2:
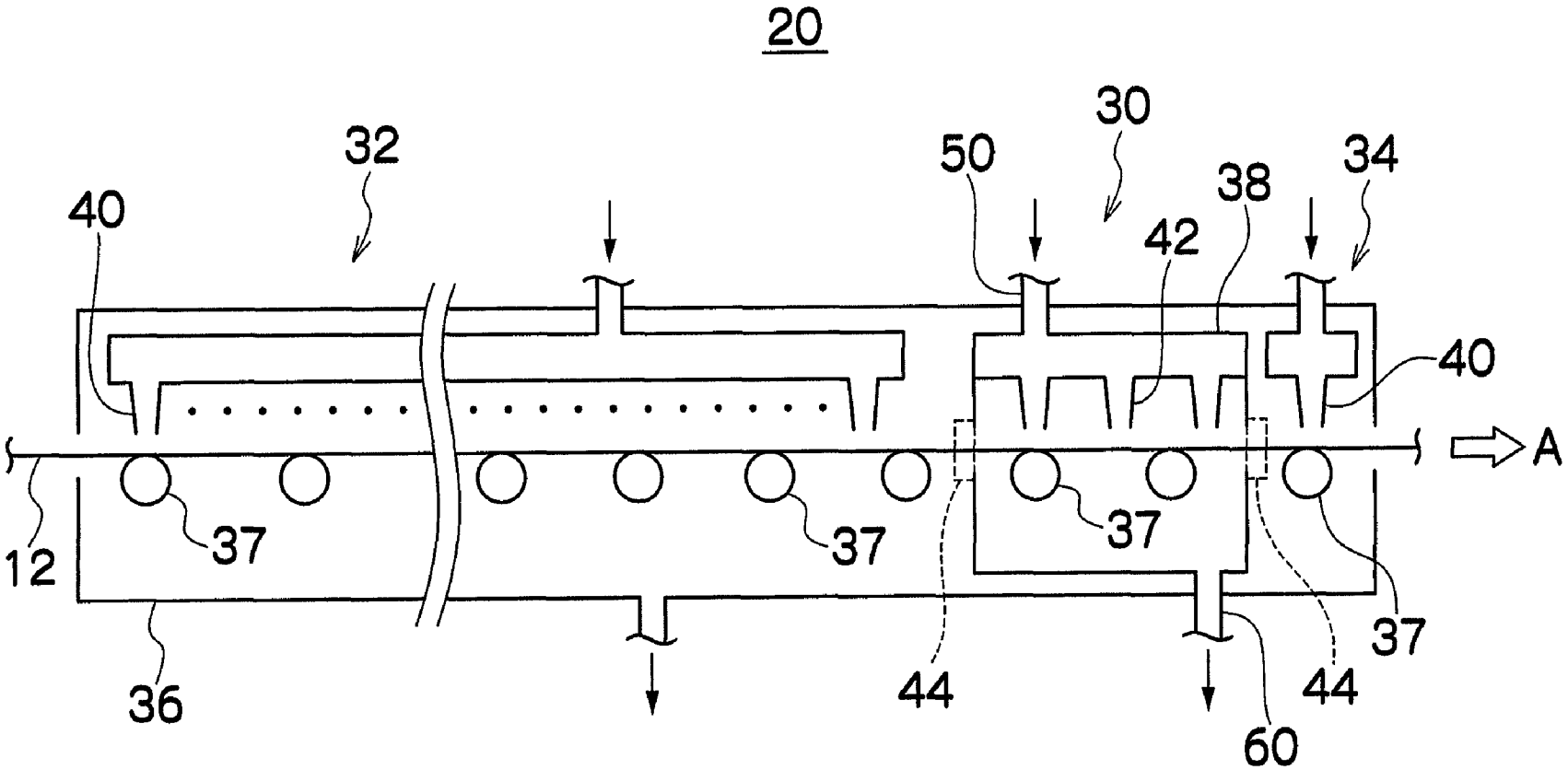
FIG. 2 is a diagram illustrating an example of a configuration of a drying apparatus according to the present invention.

FIG. 2 is a diagram illustrating an example of a configuration of the drying apparatus 20 according to the present invention. As shown in FIG. 2, the drying apparatus 20 comprises a drying box 36 formed along the conveying direction of the web 12, and has slit-like openings a lithographic printing plate enters and leaves formed on both ends of the box.

A box-like chamber 38 is disposed on the downstream side inside the drying box 36. Slit-like openings the lithographic printing plate enters and leaves are formed on both ends of the chamber 38. Conveying rollers 37 . . . to convey the web 12 on the upper surface of which the imaging layer coating liquid has been coated are provided inside the chamber 38 and inside the drying box 36.

In such a way, the interior of the drying box 36 is constituted mainly of the vapor atmosphere drying section 30 to form a second solvent vapor atmosphere in the chamber 38 for drying the web 12, and the hot air drying sections 32 and 34 to expose the web 12 to hot air for hot-air drying outside the chamber 38. In FIG. 2, the conveying direction of the web 12 is indicated by an arrow A.

A plurality of nozzles 40 . . . to blow hot air to the web 12 are disposed in the hot air drying sections 32 and 34 outside the chamber 38. Thereby, the hot air drying sections 32 and 34 are configured to blow hot air to the web 12 for drying it. Here, the number and the installation positions of the nozzles 40 are not limited to the example of FIG. 2.

A plurality of nozzles 42 . . . to eject heated air containing a low-boiling point solvent to the web 12 are disposed above the conveying rollers inside the chamber 38 of the vapor atmosphere drying section 30 (solvent vapor generating device). Thus, by forming and heating a vapor atmosphere of the second solvent (hereinafter, referred to as a low-boiling point solvent) in the chamber 38 and heating the web 12, the high-boiling point solvent contained in the imaging layer coating liquid coated on the web 12 can be dried and removed.

The low-boiling point solvent used here is preferably one whose boiling point is lower by not less than 30° C. than that of the high-boiling point solvent. The high-boiling point solvent preferably has a boiling point of not less than 150° C. Specific examples of such a high-boiling point solvent and a low-boiling point solvent will be described later.

The temperature of the vapor atmosphere of the low-boiling point solvent in the chamber 38 is preferably set higher by not less than 10° C. than the boiling point of the low-boiling point solvent to be used. The vapor amount of the low-boiling point solvent in the chamber 38 is preferably set at an amount which does not condense on the web 12.

In the case where the low-boiling point solvent is an organic solvent, the organic solvent is preferably used in a concentration of not more than the lower explosion limit or not less than the upper explosion limit, more preferably in a concentration of not less than the upper explosion limit. Further, for safety reasons, the entire interior of the drying apparatus 20 is preferably in a nitrogen atmosphere.

Thereby, in the chamber 38, the free volume in the imaging layer coated film increases by the vapor atmosphere of the low-boiling point solvent 56, and the diffusion rate of the high-boiling point solvent remaining in the imaging layer coated film rises. Further, by the synergistic effect with the increase in the total enthalpy due to inclusion of the high-temperature solvent vapor, the high-boiling point solvent can be dried and removed with high efficiency.

In the drying box 36, air curtain foaming devices 44 and 44 are provided outside the openings formed on both sides of the chamber 38, respectively. The air curtain forming devices 44 and 44 are configured to make clean air, from which dusts and foreign matters are removed with a filter or the like not shown in figure, to flow in the width direction of the web 12.

Thereby, air curtains of clean air can be formed at openings of both the ends of the chamber 38, and the leakage of the solvent vapor in the chamber 38 to the outside and the invasion of air from the outside can be inhibited. In addition, since the clean air is made to flow in the width direction, trouble such as unevenness and damage generated on the surface of the web 12 can be diminished.

Figure 3:
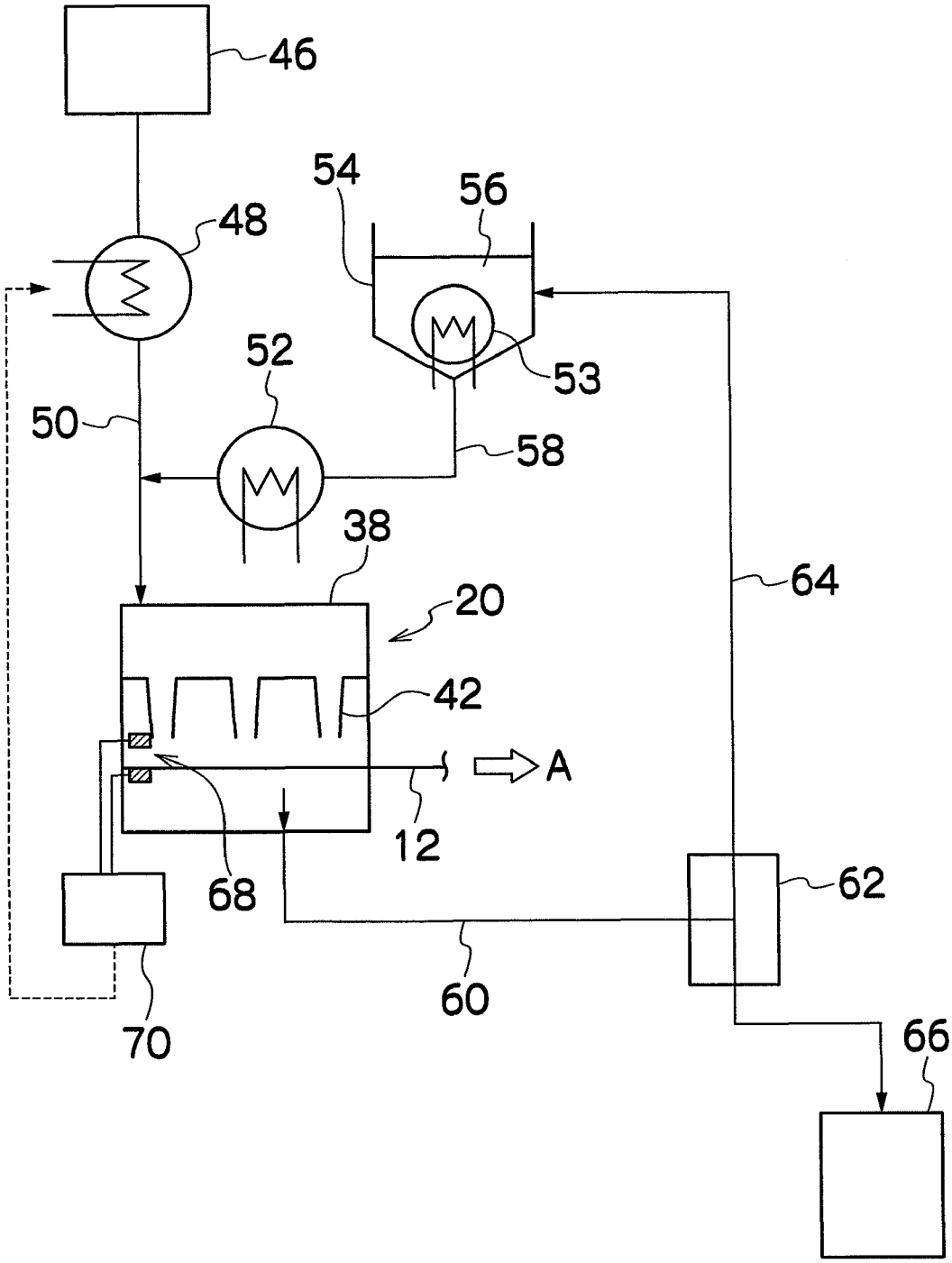
FIG. 3 is a diagram illustrating various types of control mechanisms relevant to the chamber in FIG. 2.

FIG. 3 is a diagram illustrating various types of control mechanisms relevant to the chamber 38.

As shown in FIG. 3, air sent from a blower 46 to supply warm air for nozzles 42 is heated in a first heat exchanger 48, and the interior of the chamber 38 is configured such that the air is ejected from the nozzles 42 to the web 12 in the chamber 38.

A second heat exchanger 52 and a solvent tank 54 are connected through a pipe 58 to a pipe 50 between the first heat exchanger 48 and the nozzles 42. In the solvent tank 54, the low-boiling point solvent 56 is stored and a third heat exchanger 53 is further provided. Thereby, the low-boiling point solvent 56 is heated in the third heat exchanger 53 in the solvent tank 54, then, further heated and vaporized in the second heat exchanger 52, mixed with the air passing through the pipe 50, and ejected from the nozzles 42.

The flow rate of the low-boiling point solvent 56 supplied to the second heat exchanger 52 is controlled by a flow control valve, a pump and the like, not shown in figure, installed on the way of the pipe 58.

In addition, a pipe 60 is connected to the chamber 38. The pipe 60 is connected to a distillation column 62; the low-boiling point solvent 56 and the high-boiling point solvent are separated in the distillation column 62; the low-boiling point solvent 56 is returned through a pipe 64 to the solvent tank 54; and the high-boiling point solvent is returned to a recovery tank 66. Here, a blower or the like for suction may be provided on the way of the pipe 60. The above-mentioned heat exchangers are configured to be heated by a heater or the like not shown in figure.

Respective temperature detecting devices 68 and 68 to detect the temperature of the vapor atmosphere of the low-boiling point solvent and the temperature of the web 12 in an inlet port of the chamber 38 are provided. A controlling device 70 controls the first heat exchanger 48 being the heating device such that the temperature of the web 12 is lower by a predetermined temperature difference than that of the vapor atmosphere of the low-boiling point solvent, based on the detection results by the temperature detecting devices 68 and 68 (the dotted line arrow in FIG. 3). Here, the temperature of the web 12 is preferably set lower by 5 to 100° C. than that of the vapor atmosphere of the low-boiling point solvent.

As the temperature detecting devices 68 and 68, various types of thermometers and non-contact type thermal sensors may be used. Other instruments may be used as long as they can measure or detect the temperature of the web 12 and the vapor atmosphere of the low-boiling point solvent.

As the heating device, not only heated air by the first heat exchanger 48 but a heating instrument which does not generate convection, i.e. radiant heat transfer (for example, a halogen heater, an infrared heater and microwave) and induction heat transfer (for example, self-heating of the web 12 by a high-frequency coil) may be used.

The vapor atmosphere drying section 30 is effectively installed at a position where the surface of an object to be dried is in the dry state after a drying point thereof.

Here, the "drying point" is a position in the drying apparatus 20 where a dry state is reached in which no change in glossiness of the surface of the imaging layer coated film on the web 12 has been observed. The change in glossiness can be judged, for example, by rubbing the surface of the imaging layer coated film with a bar on tip of which a cloth is wound and observing whether the coated liquid adheres to the cloth wound on the bar.

Specifically describing the drying point, in the case where the coated film is dried at a certain wind rate and temperature, the temperature of the film surface, which has been a wet-bulb temperature, begins to rise from a certain time. The period before the film surface temperature rises is referred to as the constant rate drying period, and is in a state where the intra-film movement of a volatile fraction in a film while the film is at a wet-bulb temperature is fast enough that the liquid volatizing from the surface is sufficiently present.

The period after the film surface temperature has risen is referred to as the falling drying rate period; in the falling drying rate period, the volatile fraction in the coated film is insufficiently present on its surface and the drying rate falls in a state of a slow drying rate even if the film is exposed to the same wind. The critical point between the constant rate drying period and the falling drying rate period is called a drying changing point (drying point), and is a point where the solid content becomes 70 to 90%.

The solid content mentioned herein is:

Solid content ratio(%)=solid content/(volatile content+solid content)×100. The solid content and the (volatile content+solid content) can be determined by weight measurements.

Then, the operation of the drying apparatus 20 according to the present invention will be described referring to FIG. 2 and FIG. 3.

The web 12 on which the imaging layer coating liquid is applied is conveyed through the slit-like opening into the drying box 36 of the drying apparatus 20, and conveyed by the guide rollers 37 . . . while the under surface is supported thereby.

In the hot air drying section 32 (the first drying section) of the drying box 36, hot air is blown from the plurality of nozzles 40 . . . toward the imaging layer coated film on the web 12. Thereby, the imaging layer coated film on the web 12 is heated up to the drying point.

Then, in the chamber 38 (the second drying section) installed in the drying box 36, heated air containing a vapor of the low-boiling point solvent 56 is ejected from the plurality of nozzles 42 . . . toward the imaging layer coated film on the web 12. Thereby, the web 12 is heated and the interior of the chamber 38 is filled with the vapor of the low-boiling point solvent 56.

Here, the temperature of the vapor atmosphere of the low-boiling point solvent 56 and the temperature of the web 12 in the inlet port of the chamber 38 are detected.

Then, the controlling device 70 controls the first heat exchanger 48 such that the temperature of the web 12 is lower by 5 to 100° C. than that of the vapor atmosphere of the low-boiling point solvent 56, based on the above-mentioned detection results. Thereby, the temperature of the vapor atmosphere of the low-boiling point solvent 56 supplied into the chamber 38 is adjusted.

The dew condensation of the vapor of the low-boiling point solvent on the web 12 can be suppressed by previously setting the vapor amount of the low-boiling point solvent 56 in the chamber 38 in a range which can prevent the condensation.

Thereby, in the chamber 38, the free volume in the imaging layer coated film increases with the vapor atmosphere of the low-boiling point solvent 56, and the diffusion rate of the high-boiling point solvent remaining in the imaging layer coated film rises. It is believed that at this time, since the high-boiling point solvent contains a high-temperature solvent vapor, the total enthalpy increases and their synergistic effects enable to dry and remove the high-temperature solvent with high efficiency.

The vapor atmosphere exhausted from the chamber 38 is passed through a pipe 60 and reaches the distillation column 62. Then, the high-boiling point solvent and the low-boiling point solvent are separated, and thereafter, the low-boiling point solvent is returned through the circulating pipe 64 to the solvent tank 54 for recycling.

Thereafter, the web 12 dried in the chamber 38 is conveyed to the hot air drying section 34 (the third drying section); and hot air is again blown from the plurality of nozzles 40 . . . toward the imaging layer coated film on the web 12. Thereby, the imaging layer coated film on the web 12 is further dried. At this time, since the remaining solvent in the imaging layer coated film has been replaced by the low-boiling point solvent, the drying by hot air drying becomes easy.

As described above, application of the method and apparatus for drying an object according to the present invention to a drying method and apparatus of an imaging layer coated film in manufacture of a lithographic printing plate precursor particularly enables to efficiently dry and remove a high-boiling point solvent contained in the imaging layer coated film. Further, since the thermal energy to vaporize and dry the high-boiling point solvent is reduced, the space-saving and energy-saving of the drying apparatus can be achieved. Additionally, since the drying time can be reduced, the damage to the materials can also be suppressed.

Figure 4:
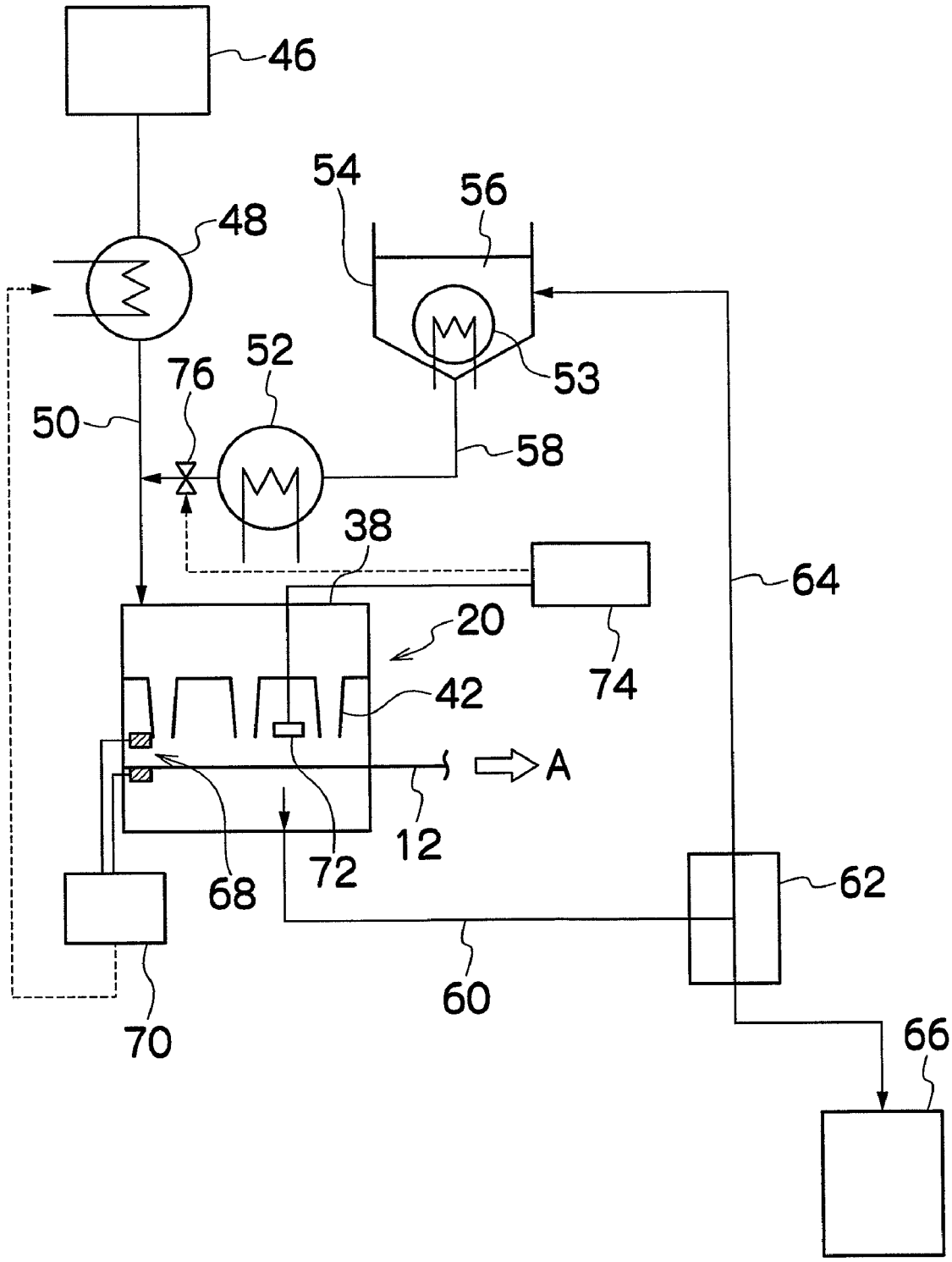
FIG. 4 is a diagram illustrating another mode of FIG. 3.

Next, other modes of various types of control mechanisms relevant to the chamber 38 will be described. FIG. 4 is a diagram illustrating other modes of various types of control mechanisms relevant to the chamber 38. In FIG. 4, the same parts and the same mechanisms as in FIG. 3 are given the same symbols, whose detailed descriptions will be omitted.

As shown in FIG. 4, a vapor amount detecting device 72 to detect the vapor amount of the low-boiling point solvent is provided. A vapor amount controlling device 74 is configured to control a valve 76 based on the detection result of the vapor amount detecting device 72. The valve 76 is configured to adjust the vapor amount of the low-boiling point solvent 56 to be mixed in the heated air ejected from the nozzles 42. Other configurations are the same as in FIG. 3.

Thereby, the vapor amount of the low-boiling point solvent in the chamber 38 can be stably maintained in a set range while continuously or intermittently monitored.

As the vapor amount detecting device 72, various types of densitometers may be used. Other instruments may be used as long as it can measure or detect the vapor amount. Further, instead of the valve 76, the vapor amount may be controlled by controlling the second heat exchanger 52. Any other instruments can be used as long as the instruments can adjust the vapor amount of the low-boiling point solvent supplied to the chamber 38 in such a way.

Here, where the vapor amount of the low-boiling point solvent in the chamber 38 is denoted as C [g/cm$^3$]; the temperature of the web 12, as T [° C.]; the saturated vapor pressure of the low-boiling point solvent at T [° C.], as $P_T$ [Pa]; the molecular weight of the low-boiling point solvent, as M; and the gas constant, as R (8.31 Pa·m$^3$/(mol·K), the vapor amount is preferably set so as to satisfy $0.25 \leqq CR(273.15+T)/(P_T \times M) < 1.0$.

Thereby, since condensation of the vapor of the low-boiling point solvent on the web 12 can securely be suppressed, the high-boiling point solvent in the imaging layer coated film can efficiently be dried and removed.

As described above, application of the method and apparatus for drying an object according to the present invention to a drying method and apparatus of an imaging layer coated film in manufacture of a lithographic printing plate precursor particularly enables to efficiently dry and remove a high-boiling point solvent contained in the imaging layer coated film at a relatively low temperature and in a short time. Further, since the thermal energy to vaporize and dry the high-boiling point solvent is reduced, the space-saving and energy-saving of the drying apparatus can be achieved. Additionally, since the drying time can be reduced, the damage to the materials can also be suppressed.

Hereinbefore, a drying method and apparatus of a lithographic printing plate precursor has been described as an example of the method and apparatus for drying an object according to the present invention, but the scope of the present invention is not limited to the above-mentioned embodiment.

In the embodiment, an example in which the temperature difference between the low-boiling point solvent in the chamber 38 and the web 12 is set by adjusting mainly the temperature of the vapor atmosphere of the low-boiling point solvent has been described, but the scope of the present invention is not limited to the embodiment.

Figure 5:
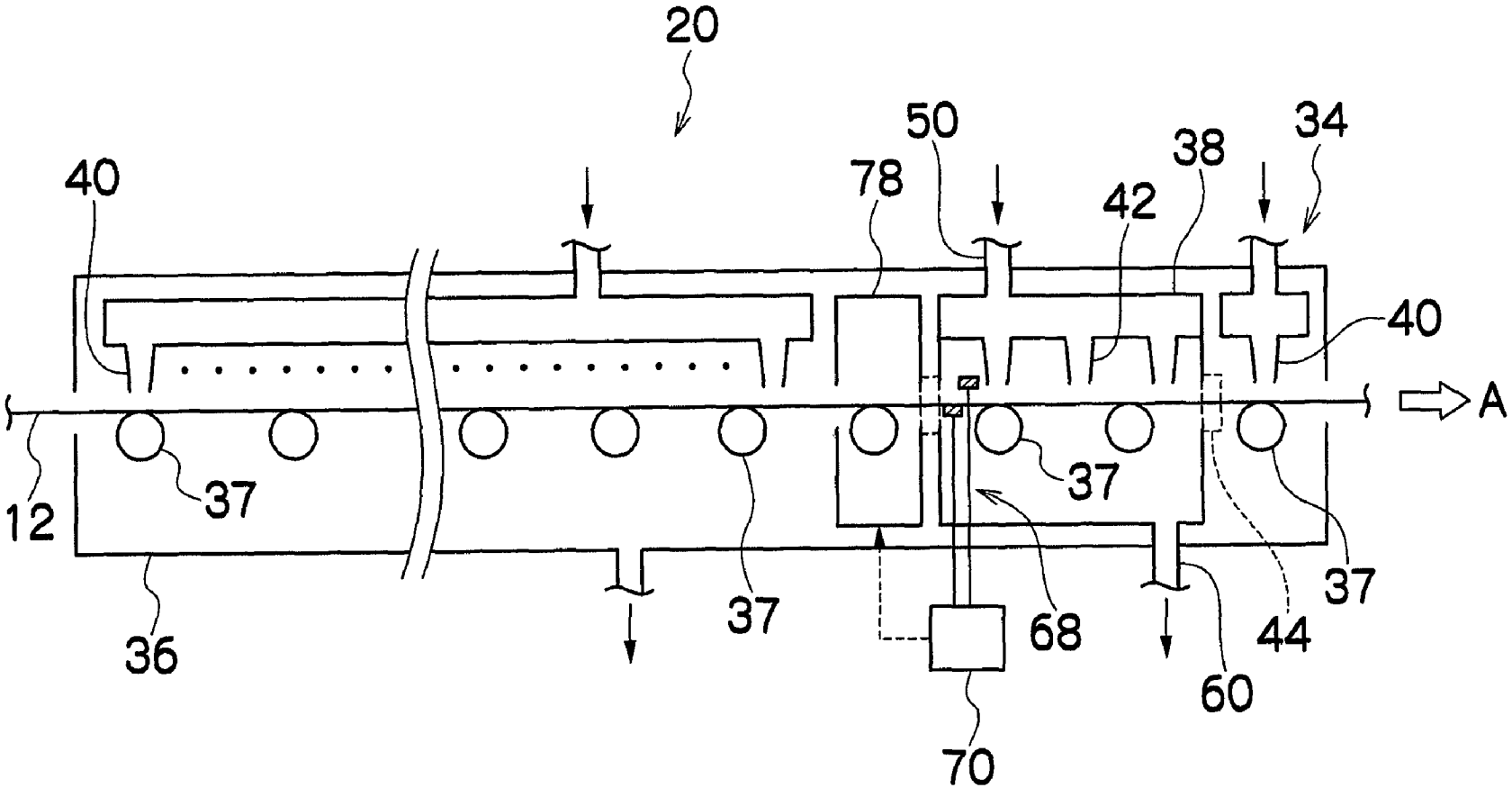
FIG. 5 is a diagram illustrating another mode of the drying apparatus in FIG. 1.

FIG. 5 is a diagram illustrating another mode of a drying apparatus. For example, as shown in FIG. 5, a cooling device 78 is provided at the prestage of the chamber 38 to cool the web 12 and the temperature of the web 12 can be thereby set lower by a predetermined temperature difference than that of the vapor atmosphere of the low-boiling point solvent 56.

As such a cooling device 78, well-known commonly-used cooling devices may be used, specifically, a method of cooling by cool air and a method of heat-exchanging with a coolant such as cooled water may be used.

In the embodiment, an example of controlling the temperature difference between the web 12 and the vapor atmosphere of the low-boiling point solvent by using the controlling device 70 has been described, but the controlling is not limited thereto and a method can also be employed in which the temperature difference between the web 12 and the vapor atmosphere of the low-boiling point solvent is controlled by adjusting the hot air drying temperature and drying time in the hot air drying section 32.

The present invention can be applied to other drying processes in a manufacturing process of lithographic printing plate precursors.

Further, the present invention can be applied not only to the manufacturing field of lithographic printing plate precursors, but also to various technical fields, for example, coating fields (manufacture of electrode materials, functional films, optical films and the like).

Then, various kinds of materials used in the embodiment will be described.

[Supporter]

In the present invention, an object to be dried is not limited to a continuously traveling belt-like supporter, and also includes metals, resins, papers and fabrics having shapes other than belt-like.

An aluminum plate used for a lithographic printing plate precursor of the embodiment is a dimensionally stable metal mainly composed of aluminum, and includes aluminum or an aluminum alloy.

Besides a pure aluminum plate, an alloy plate containing aluminum as a main component and tiny amounts of different elements, a plastic film or paper on which aluminum or an aluminum alloy is laminated or deposited, may be used. Further, a composite sheet in which an aluminum sheet is bonded to a polyethylene terephthalate film may be used.

The composition of an aluminum plate used in the embodiment is not especially limited, but a pure aluminum plate is favorably used. Since a completely pure aluminum is difficult to manufacture on the refining technology, aluminum containing tiny amounts of different elements may be used. For example, well-known materials recited in ALUMINUM HANDBOOK fourth edition (Japan Aluminum Association (1990)), specifically, for example, aluminum alloy plates such as JIS A1050, JIS A1100, JIS A3003, JIS A3004, JIS A3005 and an internationally registered alloy 3103A can be suitably used. Additionally, aluminum plates using aluminum alloys, scrap aluminum materials or secondary metals whose aluminum content is 99.4 to 95% by mass and which contain at least three elements selected from the group consisting of Fe, Si, Cu, Mg, Mn, Zn, Cr and Ti, may be used.

The aluminum content of an aluminum alloy plate is not especially limited, but may be 95 to 99.4% by mass and further this aluminum plate preferably contains at least three different elements selected from the group consisting of Fe, Si, Cu, Mg, Mn, Zn, Cr and Ti in the following ranges. This is because such a composition makes fine the crystalline grains of aluminum. Fe: 0.20 to 1.0% by mass, Si: 0.10 to 1.0% by mass, Cu: 0.03 to 1.0% by mass, Mg: 0.1 to 1.5% by mass, Mn: 0.1 to 1.5% by mass, Zn: 0.03 to 0.5% by mass, Cr: 0.005 to 0.1% by mass, and Ti: 0.01 to 0.5% by mass. The aluminum plate may contain elements such as Bi and Ni and inevitable impurities.

The manufacturing method of an aluminum plate may be either of the continuous casting system and the DC casting system, and an aluminum plate obtained by omitting the intermediate annealing and the soaking in the DC casting system may be used. An aluminum plate given irregularities by lamination rolling, transferring or the like in the final rolling may be used. An aluminum plate used in the embodiment may be an aluminum web which is a continuous belt-like sheet material or plate material, or a sheet cut into a size corresponding to a lithographic printing plate precursor shipped as a product.

The thickness of an aluminum plate used in the embodiment is commonly about 0.05 mm to 1 mm, preferably 0.1 mm to 0.5 mm. This thickness can be suitably altered according to the size of a printing machine, the size of a printing plate and user's demands.

In the manufacturing method of a supporter for a lithographic printing plate in the embodiment, the supporter for a lithographic printing plate is obtained by subjecting an above-mentioned aluminum plate to surface treatments including at least a surface roughening treatment, an anodizing treatment and a specific sealing treatment, and the surface treatments may further contain various types of treatments. In each process of the embodiment, since alloy components of an aluminum plate to be used dissolve out in a treating liquid used in the process, the treating liquid may contain the alloy components of the aluminum plate, and it is particularly preferable that the treating liquid be made in a steady state by adding those alloy components to the treating liquid before the treatment, and used.

As the surface treatments, performing an alkali etching treatment or a desmutting treatment before the electrolytic surface roughening treatment is preferable. Performing an alkali etching treatment and a desmutting treatment in this order is also preferable. Performing an alkali etching treatment or a desmutting treatment after the electrolytic surface roughening treatment is also preferable. Performing an alkali etching treatment and a desmutting treatment in this order is also preferable. The alkali etching treatment after the electrolytic surface roughening treatment may be omitted. Performing a mechanical surface roughening treatment before these treatments is also preferable. The electrolytic surface roughening treatment may be performed two or more times. Thereafter, performing the anodizing treatment, the sealing treatment, a hydrophilicizing treatment and the like is also preferable.

[Low-Boiling Point Solvent]

A low-boiling point solvent used in the embodiment is preferably that having a boiling point of not less than 30° C. and not more than 130° C. These low-boiling point solvents include the following ones, but the scope of the present invention is not limited thereto. Their boiling points are described in parentheses.

They include alcohols such as methanol (64.5° C. to 64.65° C.), ethanol (78.32° C.), n-propanol (97.15° C.), isopropanol (82.3° C.), n-butanol (117.7° C.) and isobutanol (107.9° C.), ethers such as ethyl ether (34.6° C.) and isopropyl ether (68.27° C.), ketones such as acetone (56.2° C.), methyl ethyl ketone (79.59° C.), methyl-n-propyl ketone (103.3° C.), methyl isobutyl ketone (115.9° C.) and diethyl ketone (102.2° C.), esters such as methyl acetate (57.8° C.), ethyl acetate (77.1° C.), n-propyl acetate (101.6° C.) and n-butyl acetate (1265° C.), hydrocarbons such as n-hexane (68742° C.) and cyclohexane (80.738° C.), and water.

[High-Boiling Point Solvent]

A high-boiling point solvent used in the embodiment is preferably that having a boiling point of not less than 150° C. Such a high-boiling point solvent includes the following, but the scope of the present invention is not limited thereto. Their boiling points are described in parentheses.

They include γ-butyrolactone (204° C.), acetamide (222° C.), 1,3-dimethyl-2-imidazolidinone (225.5° C.), N,N-dimethylformamide (153° C.), tetramethyluric acid (175° C. to 177° C.), nitrobenzene (211.3° C.), formamide (210.5° C.), N-methylpyrrolidone (202° C.), N,N-dimethylacetamide (166° C.) and dimethyl sulfoxide (189° C.).

[Coating Liquid]

In the present invention, a solvent used in a coating liquid is not especially limited, and includes water and various kinds of solvents.

An imaging layer of a lithographic printing plate precursor in the embodiment contains a novolac resin as a water-insoluble and alkali-soluble resin, and an infrared absorbing dye, and is a layer which increases the solubility to an alkaline aqueous solution by exposure.

(Novolac Resin)

For an imaging layer in the embodiment, a novolac phenol resin (novolac resin) containing phenol or substituted phenols as a structural unit can be used. The novolac resin is an alkali-soluble resin essential for a photosensitive layer in that the resin generates a strong hydrogen bondability in unexposed parts thereof, and a part of the hydrogen bonds is easily released in exposed parts thereof. The novolac resin is not especially limited as long as it contains phenols as a structural unit in its molecule.

The novolac resin in the embodiment is a resin obtained by the condensation reaction of phenol and substituted phenols shown below with aldehydes shown below. Phenols include, for example, phenol, isopropylphenol, t-butylphenol, t-amylphenol, hexylphenol, cyclohexylphenol, 3-methyl-4-chloro-t-butylphenol, isopropylcresol, t-butylcresol and t-amylcresol. Preferable are t-butylphenol and t-butylcresol. Aldehydes include, for example, aliphatic and aromatic aldehydes such as formaldehyde, acetoaldehyde, acrolein and crotonaldehyde. Preferable are formaldehyde and acetoaldehyde.

The weight-average molecular weight of the novolac resin is preferably 500 to 50,000, more preferably 700 to 20,000, still more preferably 1,000 to 10,000. The dispersion degree (weight-average molecular weight/number-average molecular weight) is preferably 1.1 to 10.

The proportion of the novolac resin to the total solid content in an imaging layer is preferably 5% by mass to 95% by mass, more preferably 15% by mass to 90% by mass.

Among these novolac resins, most preferable are novolac resins such as phenol formaldehyde resins, phenol/cresol (any of m-, p-, or m-/p-mixtures)-mixed formaldehyde resins. The novolac resins may be used singly or as a mixture of two or more.

For an imaging layer, another alkali-soluble resin other than a novolac resin may also be concurrently used. An alkali-soluble resin usable for an imaging layer is not especially limited as long as it has a characteristic of dissolving by contacting with an alkaline developing solution, but is preferably a single polymer containing an acidic group in its main chain and/or its side chain, a copolymer thereof, or a mixture thereof.

Such an alkali-soluble resin having an acidic group includes, particularly, (1) resins having a phenolic hydroxyl group other than the above-mentioned novolac resins, and polymeric compounds having either functional group of (2) a sulfonamide group and (3) an active imide group in their molecule. Examples are cited as follows, but the present invention is not limited thereto.

(1) The polymeric compounds having a phenolic hydroxyl group other than novolac resins to be usable include, for example, pyrogallol acetone resins and polymeric compounds having a phenolic hydroxyl group in their side chain.

Polymeric compounds having a phenolic hydroxyl group in their side chain include polymeric compounds obtained by homopolymerizing a polymerizable monomer composed of a low molecular compound having at least one phenolic hydroxyl group and at least one unsaturated bond polymerizable with a phenolic hydroxyl group, or by copolymerizing the monomer with another polymerizable monomer.

Polymerizable monomers having a phenolic hydroxyl group include acrylamides, methacrylamides, acrylates, methacrylates hydroxystyrene which have a phenolic hydroxyl group. Specifically, N-(2-hydroxyphenyl)acrylamide, N-(3-hydroxyphenyl)acrylamide, N-(4-hydroxyphenyl)acrylamide, N-(2-hydroxyphenyl)methacrylamide, N-(3-hydroxyphenyl)methacrylamide, N-(4-hydroxyphenyl)methacrylamide, o-hydroxyphenyl acrylate, m-hydroxyphenyl acrylate, p-hydroxyphenyl acrylate, o-hydroxyphenyl methacrylate, m-hydroxyphenyl methacrylate, p-hydroxyphenyl methacrylate, o-hydroxystyrene, m-hydroxystyrene, p-hydroxystyrene, 2-(2-hydroxyphenyl)ethyl acrylate, 2-(3-hydroxyphenyl)ethyl acrylate, 2-(4-hydroxyphenyl)ethyl acrylate, 2-(2-hydroxyphenyl)ethyl methacrylate, 2-(3-hydroxyphenyl)ethyl methacrylate and 2-(4-hydroxyphenyl)ethyl methacrylate, can be suitably used. Such resins having a phenolic hydroxyl group may be used in combination of two or more. Further, copolymers of formaldehyde and phenol having as a substituent an alkyl group having 3 to 8 carbon atoms, such as t-butylphenol formaldehyde resins and octylphenol formaldehyde resins, may be concurrently used.

(2) The alkali-soluble resins having a sulfonamide group include polymeric compounds obtained by homopolymerizing a polymerizable monomer having a sulfonamide group, or by copolymerizing the monomer with another polymerizable monomer. The polymerizable monomer having a sulfonamide group includes a polymerizable monomer composed of a low molecular compound having at least a sulfonamide group, —NH—$SO_2$—, in which at least one hydrogen atom is bonded to the nitrogen atom, and at least one polymerizable unsaturated bond in one molecule. Among them, low molecular compounds having an acryloyl group, allyl group, vinyloxy group, substituted or monosubstituted aminosulfonyl group or substituted sulfonylimino group, are preferable.

(3) The alkali-soluble resin having an active imide group is preferably that having an active imide group in its molecule, and such a polymer includes polymeric compounds obtained by homopolymerizing a polymerizable monomer composed of a low molecular compound having at least one active imide group and at least one unsaturated bond polymerizable with the active imide group, or by copolymerizing the monomer with another polymerizable monomer.

Such a compound to be suitably usable includes, specifically, N-(p-toluenesulfonyl)methacrylamide and N-(p-toluenesulfonyl)acrylamide.

The alkali-soluble resin is preferably a polymeric compound obtained by polymerizing at least two of the above-mentioned polymerizable monomer having a phenolic hydroxyl group, polymerizable monomer having a sulfonamide group and polymerizable monomer having an active imide group. The copolymerization ratio and the combination of the polymerizable monomers are not especially limited, but especially in the case where a polymerizable monomer having a phenolic hydroxyl group is copolymerized with a polymerizable monomer having a sulfonamide group and/or a polymerizable monomer having an active imide group, the formulated polymerization ratio of these components is preferably in the range of 50:50 to 5:95, more preferably in the range of 40:60 to 10:90.

Further, the alkali-soluble resin is preferably a polymeric compound obtained by copolymerizing one or at least two selected from the above-mentioned polymerizable monomer having a phenolic hydroxyl group, polymerizable monomer having a sulfonamide group and polymerizable monomer having an active imide group, besides, with another monomer. The copolymerization ratio in this case preferably contains not less than 10% by mol of a monomer giving alkali-solubility, more preferably not less than 20% by mol thereof.

With the copolymerization component as a monomer giving alkali-solubility of not more than 10% by mol, the alkali-solubility is liable to be insufficient and the development latitude tends to decrease.

Another polymerizable monomer usable herein is exemplified by compounds recited in the following (m1) to (m12), but the present invention is not limited thereto.

(m1) Acrylates and methacrylates having an aliphatic hydroxyl group, such as 2-hydroxyethyl acrylate and 2-hydroxyethyl methacrylate.

(m2) Alkyl acrylates, such as methyl acrylate, ethyl acrylate, propyl acrylate, butyl acrylate, amyl acrylate, hexyl acrylate, octyl acrylate, benzyl acrylate, acrylic acid-2-chloroethyl and glycidyl acrylate.

(m3) Alkyl methacrylates, such as methyl methacrylate, ethyl methacrylate, propyl methacrylate, butyl methacrylate, amyl methacrylate, hexyl methacrylate, cyclohexyl methacrylate, benzyl methacrylate, methacrylic acid-2-chloroethyl and glycidyl methacrylate.

(m4) Acrylamides and methacrylamides, such as acrylamide, methacrylamide, N-methylolacrylamide, N-ethylacrylamide, N-hexylmethacrylamide, N-cyclohexylacrylamide, N-hydroxyethylacrylamide, N-phenylacrylamide, N-nitrophenylacrylamide and N-ethyl-N-phenylacrylamide.

(m5) Vinyl ethers, such as ethyl vinyl ether, 2-chloroethyl vinyl ether, hydroxyethyl vinyl ether, propyl vinyl ether, butyl vinyl ether, octyl vinyl ether and phenyl vinyl ether.

(m6) Vinyl esters, such as vinyl acetate, vinyl chloroacetate, vinyl butyrate and vinyl benzoate.

(m7) Styrenes, such as styrene, methylstyrene and chloromethylstyrene.

(m8) Vinyl ketones, such as methyl vinyl ketone, ethyl vinyl ketone, propyl vinyl ketone and phenyl vinyl ketone.

(m9) Olefins, such as ethylene, propylene, isobutylene, butadiene and isoprene.

(m10) N-vinylpyrrolidone, acrylonitrile, methacrylonitrile, etc.

(m11) Unsaturated imides, such as maleimide, N-acryloylacrylamide, N-acetylmethacrylamide, N-propionylmethacrylamide and N-(p-chlorobenzoyl)methacrylamide.

(m12) Unsaturated carboxylic acids, such as acrylic acid, methacrylic acid, maleic anhydride and itaconic acid.

In the case where the alkali-soluble resin concurrently usable in an imaging layer is a homopolymer or a copolymer of the above-mentioned polymerizable monomers having a phenolic hydroxyl group, having a sulfonamide group and/or having an active imide group, the alkali-soluble resin preferably has a weight-average molecular weight of not less than 2,000 and a number-average molecular weight of not less than 500. The weight-average molecular weight of 5,000 to 300,000, the number-average molecular weight of 800 to 250,000, and the dispersion degree (weight-average molecular weight/number-average molecular weight) of 1.1 to 10 are more preferable.

The alkali-soluble resin used in an imaging layer can be concurrently used in 5% by mass to 900% by mass to the novolac resin, that is, optionally in the range from a small amount in the mixture to an amount nine times the novolac resin. The content of the alkali-soluble resin to the total solid content of an imaging layer is preferably used in an addition amount of 50% by mass to 98% by mass from the view point of the sensitivity and durability of the imaging layer. Here, the addition amount is an amount to the total amount of the alkali-soluble resin and the novolac resin.

(Infrared Absorbing Dye)

An infrared absorbing dye is added in an imaging layer. Addition of an infrared absorbing dye makes the imaging layer have the infrared laser responsiveness. The infrared absorbent used here has an absorption maximum at 750 nm to 1,400 nm in wavelength, and is not especially limited as long as the dye absorbs light of this wavelength and generates heat, and various types of dyes as infrared absorbing dyes can be used.

As an infrared absorbent used in the embodiment, commercially available dyes and well-known dyes described in documents (for example, DYE HANDBOOK, edited by the Society of Synthetic Organic Chemistry, Japan, 1970) can be utilized. They specifically include azo dyes, metallic complex azo dyes, pyrazolone azo dyes, anthraquinone dyes, phthalocyanine dyes, carbonium dyes, quinonimine dyes, methine dyes and cyanine dyes. Among these dyes, dyes absorbing infrared light or near-infrared light are most preferable in view of being suitable for their utilization in lasers emitting infrared light or near-infrared light.

Such a dye absorbing infrared light or near-infrared light includes, for example, cyanine dyes described in Japanese Patent Application Laid-Open Nos. 58-125246, 59-84356, 59-202829, 60-78787, etc., methine dyes described in Japanese Patent Application Laid-Open Nos. 58-173696, 58-181690, 58-194595, etc., naphthoquinone dyes described in Japanese Patent Application Laid-Open Nos. 58-112793, 58-224793, 59-48187, 59-73996, 60-52940, 60-63744, etc., squalirium dyes described in Japanese Patent Application Laid-Open Nos. 58-112792, etc., and a cyanine dye described in British Patent No. 434,875.

Further, as dyes, a near-infrared absorbing sensitizer described in U.S. Pat. No. 5,156,938 is also suitably used. A substituted arylbenzo(thio)pyrylium salt described in U.S. Pat. No. 3,881,924, a trimethinethiapyrylium salt described in Japanese Patent Application Laid-Open No. 57-142645 (U.S. Pat. No. 4,327,169), pyrylium compounds described in Japanese Patent Application Laid-Open Nos. 58-181051, 58-220143, 59-41363, 59-84248, 59-84249, 59-146063 and 59-146061, a cyanine dye described in Japanese Patent Application Laid-Open No. 59-216146, a pentamethinethiopyrylium salt, etc. described in U.S. Pat. No. 4,283,475, and pyrylium compounds disclosed in Japanese Patent Nos. 5-13514 and 5-19702, and as commercially available products, EpolightIII-178, EpolightIII-130 and EpolightIII-125, made by Epolin, Inc., are most preferably used.

Most preferable other examples of dyes include near-infrared absorbing dyes described as Formulas (I) and (II) in U.S. Pat. No. 4,756,993. Among these dyes, cyanine dyes, squalirium dyes, pyrylium salts, nickel thiolate complexes and indolenine cyanine dyes, are especially preferable. Further, cyanine dyes and indolenine cyanine dyes are preferable. A most preferable example includes cyanine dyes represented by the following general formula (I).

[Formula 1]

General Formula (i)

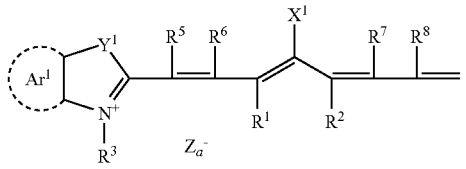

In the general formula (I), $X^1$ denotes a hydrogen atom, a halogen atom, —$NPh_2$, $X^2$-$L^1$ or a group shown below. Here, $X^2$ denotes an oxygen atom, a nitrogen atom or a sulfur atom;

and $L^1$ denotes a hydrocarbon group having 1 to 12 carbon atoms, an aromatic ring having a hetero atom or a hydrocarbon containing a hetero atom and having 1 to 12 carbon atoms. Here, the "hetero atom" denotes N, S, O, a halogen atom or Se. $Xa^-$ is defined similar to $Z^{1-}$ described later; and Ra denotes a substituent selected from a hydrogen atom, an alkyl group, an aryl group, a substituted or unsubstituted amino group and a halogen atom.

[Formula 2]

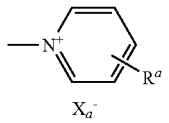

$R^1$ and $R^2$ each independently denote a hydrocarbon group having 1 to 12 carbon atoms. $R^1$ and $R^2$ are preferably a hydrocarbon group having at least 2 carbon atoms in view of the preservation stability of an imaging layer coating liquid; and $R^1$ and $R^2$ are more preferably bonded to each other to form a five-membered or six-membered ring.

$Ar^1$ and $Ar^2$ may be the same or different, and denote an aromatic hydrocarbon group which may have a substituent. The aromatic hydrocarbon group is preferably a benzene ring or a naphthalene ring; and the substituent is preferably a hydrocarbon group having at most 12 carbon atoms, a halogen atom or an alkoxy group having at most 12 carbon atoms. $Y^1$ and $Y^2$ may be the same or different, and denote a sulfur atom or a dialkylmethylene group having at most 12 carbon atoms. $R^3$ and $R^4$ may be the same or different, and denote a hydrocarbon having at most 12 carbon atoms which may have a substituent. The substituent is preferably an alkoxy group having at most 12 carbon atoms, a carboxyl group or a sulfo group. $R^5$, $R^6$, $R^7$ and $R^8$ may be the same or different from one another, and denote a hydrogen atom or a hydrocarbon having at most 12 carbon atoms, but are preferably a hydrogen atom in view of the availability of the raw material. $Za^-$ denotes a counter anion. However, in the case where a cyanine dye represented by the general formula (I) has an anionic substituent in its structure and there is no need for neutralizing its charge, $Za^-$ is not needed. $Za^-$ is preferably a halogen ion, a perchlorate ion, a tetrafluoroborate ion, a hexafluorophosphate ion and a sulfonic acid ion in view of the preservation stability of an imaging layer coating liquid, more preferably a perchlorate ion, a hexafluorophosphate ion and an arylsulfonic acid ion.

An infrared absorbing dye may be used singly or concurrently in two or more. These infrared absorbing dyes may be added in an imaging layer together with other components, or may be added to another layer provided. In the case of another layer, the addition to a layer adjacent to the imaging layer is preferable.

The infrared absorbing dye such as a cyanine dye cited as a preferable dye functions as a dissolution-inhibiting agent of an alkali-soluble resin by forming the interaction with the above-mentioned novolac resin. Here, in the case where a compound other than a compound having such a dissolution-inhibiting capability is used as an infrared absorbing dye, a dissolution-inhibiting agent described later is preferably added to an upper layer.

The addition amount of an infrared absorbing dye is preferably 0.01% by mass to 50% by mass to the total solid content of an imaging layer from the view point of the sensitivity and the uniformity of the imaging layer, more preferably 0.1% by mass to 30% by mass, still more preferably 1.0% by mass to 30% by mass.

(Development Inhibiting Agent)

An imaging layer preferably contains a development inhibiting agent for the purpose of enhancing its inhibition (dissolution-inhibiting capability).

A development inhibiting agent used in the embodiment is not especially limited, as long as it can form an interaction with an alkali-soluble resin such as the above-mentioned novolac resin, and substantially reduce the solubility of the alkali-soluble resin to a developer in unexposed parts, and weaken the interaction in exposed parts and make the alkali-soluble resin soluble to the developer, but especially quaternary ammonium salts, polyethylene glycol-based compounds and the like are preferably used. Here, in the case of using a compound functioning as an infrared absorbing dye and as a development inhibiting agent, there is necessarily no need of adding a development inhibiting agent.

The quaternary ammonium salt is not especially limited, but includes tetraalkylammonium salts, trialkylarylammonium salts, dialkyldiarylammonium salts, alkyltriarylammonium salts, tetraarylammonium salts, cyclic ammonium salts and bicyclic ammonium salts.

The addition amount of a quaternary ammonium salt is preferably 0.1% by mass to 50% by mass to the total solid content of an upper layer, more preferably 1% by mass to 30% by mass. With the addition amount of less than 0.1% by mass, the development inhibiting effect unpreferably becomes small. By contrast, with the addition amount exceeding 50% by mass, the film formability of the above-mentioned alkali-soluble resin is sometimes adversely affected.

The polyethylene glycol compound is not especially limited, but includes compounds having a structure represented by the following general formula (I).

$$R^1\text{—}\{\text{—O—}(R^3\text{—O—})m\text{—}R^2\}n \qquad \text{General Formula (1)}$$

In the above general formula (1), $R^1$ denotes a polyhydric alcohol residue or a polyhydric phenol residue; and $R^2$ denotes a hydrogen atom, or an alkyl group, alkenyl group, alkynyl group, alkyloyl group, aryl group or aryloyl group having 1 to 25 carbon atoms which may have a substituent. $R^3$ denotes an alkylene residue which may have a substituent; and m denotes an integer of not less than 10 on the average and n denotes an integer of 1 to 4 on the average.

Examples of polyethylene glycols represented by the general formula (1) include polyethylene glycols, polypropylene glycols, polyethylene glycol alkyl ethers, polypropylene glycol alkyl ethers, polyethylene glycol aryl ethers, polypropylene glycol aryl ethers, polyethylene glycol alkyl aryl ethers, polypropylene glycol alkyl aryl ethers, polyethylene glycol glycerol esters, polypropylene glycol glycerol esters, polyethylene sorbitol esters, polypropylene glycol sorbitol esters, polyethylene glycol fatty acid esters, polypropylene glycol fatty acid esters, polyethylene glycolized ethylenediamines, polypropylene glycolized ethylenediamines, polyethylene glycolized diethylenetriamines and polypropylene glycolized diethylenetriamines.

The addition amount of a polyethylene glycol compound is preferably 0.1% by mass to 50% by mass to the total solid content of an upper layer from the view point of the development inhibiting effect and the image formability, more preferably 1% by mass to 30% by mass.

In the case of taking measures for enhancing such inhibition (dissolution-inhibiting capability), the sensitivity decreases, but addition of a lactone compound is effective. The lactone compound conceivably improves the sensitivity due to that, when a developer penetrates an exposure part, i.e.

an imaging layer in a region released from the inhibition, the reaction of the developer and the lactone compound newly generates a carboxylic acid compound and promotes dissolution of the imaging layer in the exposure part.

Such a lactone compound is not especially limited, but includes compounds represented by the following general formula (L-I) and general formula (L-II).

[Formula 3]

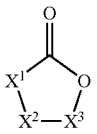

General Formula (L-I)

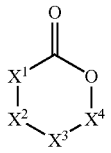

General Formula (L-II)

In the general formula (L-I) and general formula (L-II), $X^1$, $X^2$, $X^3$ and $X^4$ are a bivalent nonmetallic atom or nonmetallic atom group, and may be the same as or different from one another. These may each independently have a substituent. Further, at least one of $X^1$, $X^2$ and $X^3$ of the general formula (L-I) and at least one of $X^1$, $X^2$, $X^3$ and $X^4$ of the general formula (L-II) are preferably an electron withdrawing substituent of a substituent substituted with an electron withdrawing group.

Such a nonmetallic atom or nonmetallic atom group is preferably an atom or atom group selected from a methylene group, a sulfinyl group, a carbonyl group, a thiocarbonyl group, a sulfonyl group, a sulfur atom, an oxygen atom and a selenium atom, more preferably an atom group selected from a methylene group, a carbonyl group and a sulfonyl group.

The "electron withdrawing substituent" indicates a group whose Hammett substituent constant p takes a positive value. With respect to the Hammett substituent constant, Journal of Medicinal Chemistry, 1973, Vol. 16, No. 11, 1207-1216 and the like can be referred to. The electron withdrawing group whose Hammett substituent constant p takes a positive value includes, for example, halogen atoms [a fluorine atom (p value: 0.06), a chlorine atom (p value: 0.23), a bromine atom (p value: 0.23) and an iodine atom (p value: 0.18)], trihaloalkyl groups [tribromomethyl (p value: 0.29), trichloromethyl (p value: 0.33) and trifluoromethyl (p value: 0.54)], a cyano group (p value: 0.66), a nitro group (p value: 0.78), aliphatic, aryl, or heterocyclic sulfonyl groups [for example, methanesulfonyl (p value: O.72)], aliphatic, aryl or heterocyclic acyl groups [for example, acetyl (p value: 0.50), benzoyl (p value: 0.43)], alkynyl groups [for example, C≡CH (p value: 0.23)], aliphatic, aryl or heterocyclic oxycarbonyl groups [for example, methoxycarbonyl (p value: 0.45) and phenoxycarbonyl (p value: 0.44)], a carbamoyl group (p value: 0.36), a sulfamoyl group (p value: 0.57), a sulfoxide group, a heterocyclic group, an oxo group and a phosphoryl group.

The electron withdrawing group is preferably a group selected from an amide group, azo group, nitro group, fluoroalkyl groups having 1 to 5 carbon atoms, nitrile group, alkoxycarbonyl groups having 1 to 5 carbon atoms, acyl groups having 1 to 5 carbon atoms, alkylsulfonyl groups having 1 to 9 carbon atoms, arylsulfonyl groups having 6 to 9 carbon atoms, alkylsulfinyl groups having 1 to 9 carbon atoms, arylsulfinyl groups having 6 to 9 carbon atoms, arylcarbonyl groups having 6 to 9 carbon atoms, thiocarbonyl group, fluorine-containing alkyl groups having 1 to 9 carbon atoms, fluorine-containing aryl groups having 6 to 9 carbon atoms, fluorine-containing aryl groups having 3 to 9 carbon atoms, oxo group and halogen elements, more preferably a nitro group, fluoroalkyl groups having 1 to 5 carbon atoms, nitrile group, alkoxycarbonyl groups having 1 to 5 carbon atoms, acyl groups having 1 to 5 carbon atoms, arylsulfonyl groups having 6 to 9 carbon atoms, arylcarbonyl groups having 6 to 9 carbon atoms, oxo group and halogen elements.

The addition amount of a compound represented by the general formula (L-I) and the general formula (L-II) is preferably 0.1% by mass to 50% by mass, more preferably 1% by mass to 30% by mass.

The lactone compound may be used singly or concurrently in two or more. In the case of using at least two compounds of the general formula (L-I) or at least two compounds of the general formula (L-II), the compounds can be concurrently used in any proportion as long as the total addition amount is in the above range.

Besides, concurrent use of substances which are thermally decomposable and substantially reduce the solubility of an alkali-soluble resin in the undecomposed state, such as onium salts, o-quinonediazide compounds, aromatic sulfone compounds and aromatic sulfonate compounds, is preferable in view of improving the inhibition against a developer of an image forming part.

Onium salts include diazonium salts, ammonium salts, phosphonium salts, iodonium salts, sulfonium salts, selenonium salts and arsonium salts.

Counter ions of onium salts include tetrafluoroboric acid, hexafluorophosphoric acid, triisopropylnaphthalenesulfonic acid, 5-nitro-o-toluenesulfonic acid, 5-sulfosalicylic acid, 2,5-dimethylbenzenesulfonic acid, 2,4,6-trimethylbenzenesulfonic acid, 2-nitrobenzenesulfonic acid, 3-chlorobenzenesulfonic acid, 3-bromobenzenesulfonic acid, 2-fluorocaprylnaphthalenesulfonic acid, dodecylbenzenesulfonic acid, 1-naphthol-5-sulfonic acid, 2-methoxy-4-hydroxy-5-benzoyl-benzenesulfonic acid and paratoluenesulfonic acid. Among these, particularly hexafluorophosphoric acid and alkylaromatic sulfonic acids such triisopropylnaphthalenesulfonic acid and 2,5-dimethylbenzenesulfonic acid are suitable.

Additionally, an ester of naphthoquinone-(1,2)-diazido-4-sulfonyl chloride with a phenol-formaldehyde resin or a cresol-formaldehyde resin, and an ester of naphthoquinone-(1,2)-diazido-4-sulfonyl chloride with a pyrogallol-acetone resin are similarly suitably used.

The addition amount of an o-quinonediazide compound is preferably 1% by mass to 50% by mass to the total solid content of an imaging layer, more preferably 5% by mass to 30% by mass, still more preferably 10% by mass to 30% by mass. These compounds may be used singly or as a mixture of several kinds thereof.

For the purpose of strengthening the inhibition of the surface of an imaging layer and strengthening the resistance against scratches on the surface, a polymer whose polymerization component is a (meth)acrylate monomer having two or three perfluoroalkyl groups having 3 to 20 carbon atoms in its molecule is preferably concurrently used as described in Japanese Patent Application Laid-Open No. 2000-187318. The addition amount is preferably 0.1% by mass to 10% by mass to the total solid content of an imaging layer, more preferably 0.5% by mass to 5% by mass.

(Other Additives)

On forming an imaging layer, various types of additives can be further optionally added other than the above-mentioned essential components.

(1) Development Promoting Agent

For improving the sensitivity, acid anhydrides, phenols and organic acids may be added to an imaging layer.

The acid anhydrides are preferably cyclic acid anhydrides, and specifically, acid anhydrides such as phthalic anhydride, tetrahydrophthalic anhydride, hexahydrophthalic anhydride, 3,6-endoxy-tetrahydrophthalic anhydride, tetrachlorophthalic anhydride, maleic anhydride, chloromaleic anhydride, phenylmaleic anhydride, succinic anhydride and pyromellitic anhydride, which are described in U.S. Pat. No. 4,115,128. Noncyclic acid anhydrides include acetic anhydride.

The phenols include bisphenol A, 2,2'-bishydroxysulfone, p-nitrophenol, p-ethoxyphenol, 2,4,4'-trihydroxybenzophenone, 2,3,4-trihydroxybenzophenone, 4-hydroxybenzophenone, 4,4',4"-trihydroxytriphenylmethane and 4,4',3",4"-tetrahydroxy-3,5,3',5'-tetramethyltriphenylmethane.

The organic acids include sulfonic acids, sulfinic acids, alkylsulfuric acids, phosphonic acids, and phosphates and carboxylic acids, which are described in Japanese Patent Application Laid-Open Nos. 60-88942 and 2-96755, and the like, and specifically include p-toluenesulfonic acid, dodecylbenzenesulfonic acid, p-toluenesulfinic acid, ethylsulfuric acid, phenylphosphonic acid, phenylphosphinic acid, phenyl phosphate, diphenyl phosphate, benzoic acid, isophthalic acid, adipic acid, p-toluic acid, 3,4-dimethoxybenzoic acid, phthalic acid, terephthalic acid, 4-cyclohexene-1,2-dicarboxylic acid, erucic acid, lauric acid, n-undecanoic acid and ascorbic acid.

The proportions of the above-mentioned acid anhydrides, phenols and organic acids to the total solid content of a lower layer or an upper layer are preferably 0.05% by mass to 20% by mass, more preferably 0.1% by mass to 15% by mass, still more preferably 0.1% by mass to 10% by mass.

(2) Surfactant

For upgrading the coatability and expanding the stability of treatments for development conditions, nonionic surfactants described in Japanese Patent Application Laid-Open Nos. 62-251740 and 3-208514, amphoteric surfactants described in Japanese Patent Application Laid-Open Nos. 59-121044 and 4-13149, siloxane compounds described in EP 950517 gazette, and fluorine-containing monomer copolymers described in Japanese Patent Application Laid-Open Nos. 62-170950 and 11-288093 and Japanese Patent Application No. 2001-247351, can be added to an imaging layer.

Specific examples of nonionic surfactants include sorbitan tristearate, sorbitan monopalmitate, sorbitan trioleate, stearic acid monoglyceride and polyoxyethylene nonylphenyl ether. Specific examples of amphoteric surfactants include alkyldi(aminoethyl)glycines, alkylpolyaminoethylglycine hydrochloric acid salts, 2-alkyl-N-carboxyethyl-N-hydroxyethylimidazolinium betaine and a N-tetradecyl-N,N-betaine type (for example, trade name, "Amogen K", made by Dai-Ichi Kogyo Seiyaku Co., Ltd.).

The siloxane compound is preferably a block copolymer of dimethylsiloxane and a polyalkylene oxide, and specifically includes polyalkylene oxide-modified silicones such as DBE-224, DBE-621, DBE-712, DBP-732 and DBP-534, made by Chisso Corp., and TegoGlide100, made by Tego (Germany).

The proportion of the nonionic surfactant and the amphoteric surfactant in the total solid content in an imaging layer is preferably 0.01% by mass to 15% by mass, more preferably 0.1% by mass to 5% by mass, still more preferably 0.05% by mass to 0.5% by mass.

(3) Printing-Out Agent/Colorant

A printing-out agent to obtain visible images and a dye and pigment as an image colorant can be added to an imaging layer immediately after heating by exposure.

The printing-out agent includes a combination of a compound (photoacid releasing agent) to release an acid through heating by exposure and an organic dye capable of forming a salt. The agent specifically includes a combination of o-naphthoquinonediazide-4-sulfonic acid halogenid and a salt-formable organic dye, described in Japanese Patent Application Laid-Open Nos. 50-36209, and 53-8128, and a combination of a trihalomethyl compound and a salt-formable organic dye, described in Japanese Patent Application Laid-Open Nos. 53-36223, 54-74728, 60-3626, 61-143748, 61-151644 and 63-58440. Such a trihalomethyl compound includes oxazol compounds and triazine compounds, which both excel in the stability over time and give clear printing-out images.

The image colorant to be usable includes other dyes other than the above-mentioned salt-formable organic dyes. Suitable dyes besides the salt-formable organic dyes include oil-soluble dyes and basic dyes. The dyes specifically include Oil Yellow #101, Oil Yellow #103, Oil Pink #312, Oil Green BG, Oil Blue BOS, Oil Blue #603, Oil Black BY, Oil Black BS and Oil Black T-505 (made by Orient Chemical Industries), and Victoria Pure Blue, Crystal Violet Lactone, Crystal Violet (CI42555), Methyl Violet (CI42535), Ethyl Violet, Rhodamine B (CI145170B), Malachite Green (CI42000) and Methylene Blue (CI52015). A dye described in Japanese Patent Application Laid-Open No. 62-293247 is most preferable. The addition amount of these dyes is preferably 0.01% by mass to 10% by mass to the total solid content of an upper layer or a lower layer, more preferably 0.1% by mass to 3% by mass.

(4) Plasticizer

A plasticizer may be added to an imaging layer for imparting flexibility and the like to a coating film. The plasticizer to be used includes, for example, butylphthanyl, polyethylene glycol, tributyl citrate, diethyl phthalate, dibutyl phtalate, dihexyl phthalate, dioctyl phthalate, tricresyl phosphate, tributyl phosphate, trioctyl phosphate, tetrahydrofurfuryl oleate and oligomers or polymers of acrylic acid or methacrylic acid. The addition amount of these plasticizers is preferably 1% by mass to 20% by mass to the total solid content of an imaging layer, more preferably 2% by mass to 5% by mass.

(5) WAX Agent

A compound to reduce the surface static friction coefficient may be added to an imaging layer for the purpose of imparting the resistance against scratches. The compound specifically includes that having an ester of long-chain alkylcarboxylic acid and the like as described in U.S. Pat. No. 6,117,913 and Japanese Patent Application Nos. 2001-261627, 2002-032904 and 2002-165584. The addition amount of the WAX agent is preferably 0.1% by mass to 10% by mass, more preferably 0.5% by mass to 5% by mass.

In the lithographic printing plate precursor of the embodiment, an imaging layer can be commonly formed by dissolving each above-mentioned component in a solvent and applying the solution on a suitable supporter. The imaging layer may have a single layer structure or a multilayer structure.

A solvent to be used here includes ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethyl sulfoxide, sulfolane, γ-butyrolactone and toluene, but is not limited thereto. These solvents are used singly or as a mixture thereof. The coating amount after drying of an imaging layer is preferably in the range of 0.05 g/m$^2$ to 5.0 g/m$^2$ from the view point of the sensitivity and the development latitude, more preferably 0.5 g/m$^2$ to 3 g/m$^2$.

In the lithographic printing plate precursor in the embodiment, a protecting layer, an undercoat layer and the like can be provided other than the above-mentioned imaging layer according to the purposes.

For example, between a supporter and an imaging layer, a lower layer containing a water-insoluble and alkali-soluble resin can be provided. Such a lower layer and the imaging layer may form an imaging layer having a multilayer structure.

As an alkali-soluble resin contained in the lower layer, since the lower layer itself is required to develop a high alkali-solubility especially in the non-image region, a resin not impairing this characteristic must be selected.

From the view point of this, alkali-soluble resins other than novolac resins in the above descriptions of an imaging layer are preferably included. Among these, resins which more hardly form the interaction than the novolac resins used for an imaging layer and excel in the solubility to an alkali developer liquid are preferably selected from the view point of the sensitivity and the image formability, and preferably include, for example, polyamide resins, epoxy resins, acetal resins, acrylic resins, methacrylic resins, styrene resins and urethane resins.

[Mat Layer]

On the surface of an imaging layer provided as described above, for shortening the time of vacuuming in contact exposure using a vacuum printing frame and preventing insufficient printing, a mat layer may be provided. The providing method includes a method in which a mat layer is laid on and a method in which a solid powder is thermally vapor-deposited and so on.

[Back Coat Layer]

On the back surface (the surface on which an imaging layer is not provided) of the lithographic printing plate precursor obtained as described above, a coating layer (hereinafter, also referred to as "back coat layer") composed of an organic polymeric compound may be optionally provided for the imaging layer not to be damaged even if the plates are stacked. The main component of the back coat layer to be used is preferably at least one resin selected from the group consisting of saturated copolymerized polyester resins, phenoxy resins, polyvinyl acetal resins and vinylidene chloride copolymerized resins, which have a glass transition temperature of not less than 20° C.

The saturated copolymerized polyester resins are composed of a dicarboxylic acid unit and a diol unit. The dicarboxylic acid unit includes, for example, aromatic dicarboxylic acids such as phthalic acid, terephthalic acid, isophthalic acid, tetrabromophthalic acid and tetrachlorophthalic acid; and saturated aliphatic dicarboxylic acids such as adipic acid, azelaic acid, succinic acid, oxalic acid, suberic acid, sebacic acid, malonic acid and 1,4-cyclohexanedicarboxylic acid.

The back coat layer additionally suitably contain a dye or pigment for coloring, a silane coupling agent, diazo resin composed of a diazonium salt, organic phosphonic acid, organic phosphoric acid or cationic polymer for improving the adhesiveness with a supporter, and a wax, higher fatty acid, higher fatty acid amide, silicone compounds composed of dimethylsiloxane, modified dimethylsiloxane, polyethylene powder or the like, commonly used as a lubricant.

The thickness of the back coat layer is such that the imaging layer is hardly damaged basically even without a guard sheet, preferably 0.01 μm to 8 μm. With the thickness of less than 0.01 μm, prevention of rubbing scratches of the imaging layer when lithographic printing plate precursors are stackingly handled is difficult. By contrast, with the thickness exceeding 8 μm, chemicals used around a lithographic printing plate during printing sometimes swell the back coat and vary the thickness thereof, deteriorating printing characteristics due to variation in printing pressure.

Methods to be used for providing a back coat on the back surface of a lithographic printing plate precursor involve various types of methods. For example, the methods include a method in which components for the back coat layer are dissolved in a suitable solvent and applied, or emulsified as a dispersion liquid and applied, and dried; a method in which a previously formed film is laminated on a lithographic printing plate precursor by an adhesive or heat; and a method in which a melted film is formed by a melt extruder and laminated on a lithographic printing plate precursor. Most preferable for securing a suitable thickness is the method in which components for the back coat layer are dissolved as a solution in a suitable solvent, applied, and dried.

In manufacture of a lithographic printing plate precursor, either of a back coat layer on the back surface and an imaging layer on the front surface may be first provided on a supporter, or both thereof may be simultaneously provided.

The lithographic printing plate precursor thus obtained is, as required, cut into a suitable size, exposed and developed, and subjected to platemaking to obtain a lithographic printing plate. In the case of a lithographic printing plate precursor provided with a visible light exposure type platemaking layer (photosensitive platemaking layer), a transparent film in which printing images are formed is overlaid thereon, exposed to irradiation of common visible light, and thereafter developed for platemaking. In the case of a lithographic printing plate precursor provided with a laser exposing type platemaking layer, the plate is exposed by directly writing printing images by irradiation of various types of laser light, and thereafter developed for platemaking.

EXAMPLES

Then, the present invention will be described further in detail by way of Examples, but the scope of the present invention is not limited to the following Examples. Hereinafter, drying tests of imaging layer coated liquids were performed in a drying apparatus 20 of FIG. 2.

Examples 1-1 and 1-2, and Comparative Example 1-1

First, according to each condition shown in Table 1 of FIG. 6, an imaging layer coated film is dried by hot air in a hot air drying section 32, and thereafter dried by a vapor in a vapor atmosphere drying section 30. The changeover from the hot air drying section 32 to the vapor atmosphere drying section 30 was set at immediately after the solidification of the coated film (drying point). The amount of γ-butyrolactone remaining in the coated film immediately after the drying point was 100 mg/m$^2$. The temperature of a web 12 was adjusted at a set temperature by shifting the hot air drying temperature and the drying time in the hot air drying section 32. The maximum achieving temperature of the web 12 in an outlet port of the drying apparatus 20 of FIG. 2 (outlet port of the hot air drying section 34) was measured.

In the Examples, an aluminum web (material: JIS A1050) of 600 mm in width and 0.3 mm in thickness was used. In Examples 1-1 and 1-2, vapor atmosphere drying was performed according to the following conditions. The results are collectively shown in Table 1.

(Drying Conditions in the Vapor Atmosphere Drying Section 30)

The conveyance speed of the aluminum web: 20 m/min

The drying time in a vapor atmosphere in a chamber 38: 1.5 sec

The temperature of a low-boiling point solvent vapor: 110° C. (Example 1-2), 140° C. (Example 1-1)

The wind rate of the low-boiling point solvent vapor: 25 $m^3$/hour

A high-boiling point solvent: γ-butyrolactone

The low-boiling point solvent: water (Example 1-1), methyl ethyl ketone (MEK) (Example 1-2)

(Measuring Method of a Remaining High-Boiling Point Solvent Amount)

A coated film sample applied on the aluminum web was cut out in 30 mm×10 mm for each aluminum web, put in a vial and hermetically closed. The vial was charged in a dedicated apparatus, heated at 180° C. for 5 min, and thereafter, a part of gas in the vial was taken out with a syringe equipped with in the apparatus, and analyzed by gas chromatography. The concentration of the solvent remaining in the coated film was calculated from a peak area of the obtained chromatogram and a calibration curve previously prepared.

As shown in Table 1, in either of Example 1-1 using steam of 140° C. and Example 1-2 using MEK vapor of 110° C., the remaining γ-butyrolactone amount in the coated film is found to be removed in a short time even if the temperature of the web 12 in the chamber 38 was relatively low.

By contrast, in Comparative Example 1-1 in which drying was performed by hot air alone, as is clear from that the maximum achieving temperature of the web is remarkably higher than those in Examples 1-1 and 1-2, removal of the remaining γ-butyrolactone amount in the coated film requires the high-temperature and long-time hot air drying, and the energy for drying increases. Here, the temperature difference ΔT in Table 1 refers to a temperature difference between the web 12 and the vapor atmosphere in the inlet port of the chamber 38.

By applying the present invention in such a way, it is found that the temperature of the web 12 (maximum achieving temperature of the web 12) in the inlet port of the drying apparatus 20 can also be reduced.

Examples 2-1 to 2-6, and Comparative Examples 2-1 to 2-6

According to each condition shown in Table 2 of FIG. 7, an imaging layer coated film is dried by hot air in a hot air drying section 32, and thereafter dried by a vapor in a vapor atmosphere drying section 30. The changeover from the hot air drying section 32 to the vapor atmosphere drying section 30 was set at immediately after the solidification of the coated film (drying point). The amount of γ-butyrolactone remaining in the coated film immediately after the drying point was 100 mg/$m^2$. The temperature of a web 12 was adjusted at a set temperature by shifting the hot air drying temperature and the drying time in the hot air drying section 32. The web 12 similar to that in Example 1-1 was used.

(Drying Conditions in the Vapor Atmosphere Drying Section 30)

The conveyance speed of the aluminum web: 20 m/min

The drying time in a vapor atmosphere in a chamber 38: 1.5 sec

The temperature of a heated air containing a low-boiling point solvent vapor: 140° C.

The wind rate of the heated air containing the low-boiling point solvent vapor: 25 $m^3$/hour A high-boiling point solvent: γ-butyrolactone The low-boiling point solvent: water A measuring method of a remaining high-boiling point solvent amount was a method similar to that in Example 1-1. The results are collectively shown in Table 2 of FIG. 7.

As shown in Table 2, in Examples 2-1 to 2-6 in which the vapor atmosphere drying according to the present invention was carried out, γ-butyrolactone remaining in the coated film is found to be reduced to less than about a half thereof event if the temperature of the web 12 is relatively low. Particularly in Examples 2-3 to 2-5 in which the temperature difference between the web 12 and the vapor atmosphere in the inlet port of the chamber 38 is large, the remaining γ-butyrolactone amount is found to be largely reduced even if drying by hot air is carried out at a relatively low temperature. The temperature of the web 12 in Table 2 refers to a temperature thereof in the inlet port of the chamber 38.

In Examples 2-4 to 2-6, dew condensation was observed, but it was confirmed that the effect of removal by drying of the γ-butyrolactone remaining in the coated film could be obtained. With the temperature difference ΔT exceeding 100° C., the hot air drying time before the changeover to the vapor atmosphere drying is long and the drying time is found to have a tendency of being longer than that in the hot air drying alone as a total (Example 2-6).

By contrast, in Comparative Examples 2-1 to 2-3 in which the vapor atmosphere drying conditions are out of the range of the present invention, the temperature of the web 12 is made to be high and the energy needed for drying increases. Among them, in Comparative Example 2-3, the vapor amount of the vapor atmosphere is small and the drying effect of the present invention is low.

In Comparative Examples 2-4 to 2-6 in which drying was carried out by hot air alone, although the γ-butyrolactone remaining in the coated film after drying is reduced, the hot air drying temperature must be made high and the drying time must be made long. Therefore, the energy needed for drying increases.

Further, in Example 2-2 and Example 2-3, and in Comparative Example 2-7 in which drying was carried out by a dried air containing no low-boiling point solvent, the remaining γ-butyrolactone amount in the imaging layer coated film was measured. The hot air drying of Comparative Example 2-7 was set at a hot air temperature of 140° C. and a drying time of 60 sec. The results are shown in FIG. 8.

Figure 8:
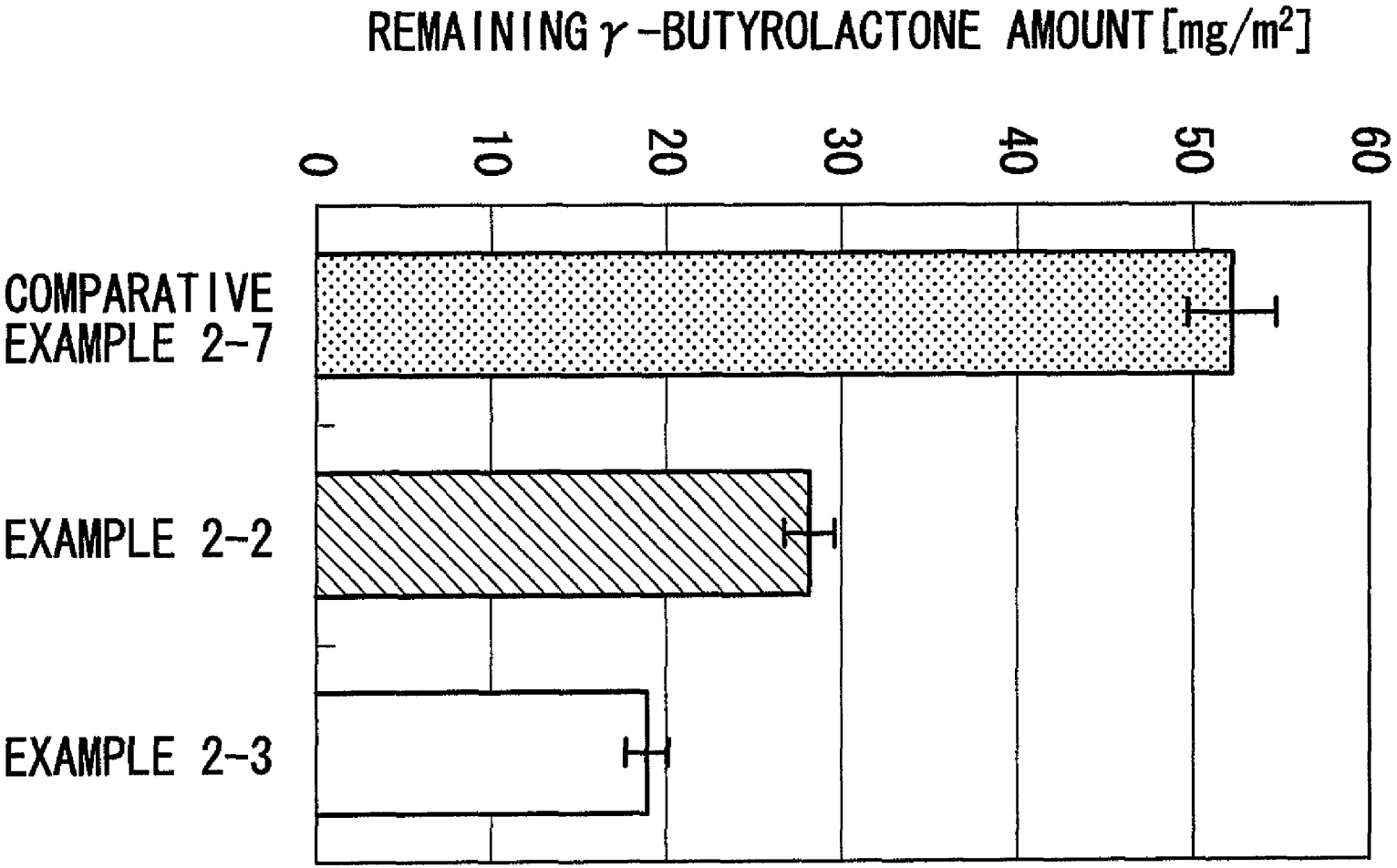
FIG. 8 is a graph showing results of the Examples.

As shown in FIG. 8, in Example 2-2, the remaining γ-butyrolactone amount in the imaging layer coated film is more largely reduced than that in Comparative Example 2-7 in which drying was carried out in dried air. Further, in Example 2-3 in which the temperature difference between the aluminum web and the steam is larger than that in Example 2-2, the remaining γ-butyrolactone amount is found to be more reduced than that in Example 2-2.

From the above results, it is found that by applying the method for drying an object according to the present invention, the web 12 can be dried at a relatively low temperature and short time and the energy needed for drying can be reduced.

The invention claimed is:

1. A drying method for drying an object containing a first solvent while the object is conveyed,-comprising:

a first drying step of drying the object up to a drying point; and a second drying step of forming, in a drying chamber at a post stage of the first drying step, a vapor atmosphere of a second solvent having a lower boiling point than the first solvent and drying the object such that a temperature of the object in an inlet port of the drying chamber is made to be lower by a predetermined temperature difference than a temperature of the vapor atmosphere, wherein $$0.25 \leqq CR(273.15+T)/(P_T \times M) < 1.0$$

is satisfied where a vapor amount of the second solvent is denoted as C [g/m$^3$]; a temperature of the object is denoted as T [° C.]; a saturated vapor pressure of the second solvent at T° C. is denoted as $P_T$ [Pa]; the molecular weight of the second solvent is denoted as M; and the gas constant is denoted as R (8.31 Pa·m$^3$/(mol·K)).

2. The drying method for drying an object according to claim 1 further comprising:

a temperature detecting step of detecting a temperature of the vapor atmosphere of the second solvent and a temperature of the object; and a temperature controlling step of controlling the temperature of the object and/or the temperature of the vapor atmosphere of the second solvent such that the temperature of the object is lower by a predetermined temperature difference than the temperature of the vapor atmosphere, based on the detected results obtained by the temperature detecting step.

3. The drying method for drying an object according to claim 1 further comprising:

a vapor amount detecting step of detecting a vapor amount of the second solvent in the drying chamber to form the vapor atmosphere of the second solvent; and a vapor amount controlling step of controlling the vapor amount of the second solvent supplied to the drying chamber such that the vapor amount of the second solvent in the drying chamber is in a predetermined range, based on the detected result obtained by the vapor amount detecting step.

4. A manufacturing method of a lithographic printing plate precursor, wherein the drying method of an object according to claim 1 is applied to the manufacturing method.

5. A drying apparatus for drying an object containing a first solvent while the object is conveyed, comprising:

a first drying section to dry the object up to a drying point; and a second drying section to form a vapor atmosphere of a second solvent having a lower boiling point than the first solvent in a drying chamber provided at a post stage of the first drying section and to dry the object such that a temperature of the object in an inlet port of the drying chamber is made to be lower by a predetermined temperature difference than a temperature of the vapor atmosphere, wherein the second drying section comprises:

a solvent vapor generating device to generate a second solvent having a lower boiling point than the first solvent and to form a vapor atmosphere of the second solvent in the drying chamber;

a heating device to heat the object in the drying chamber;

a temperature detecting device to detect a temperature of the vapor atmosphere of the second solvent and a temperature of the object in an inlet port of the drying chamber; and a controlling device to control the heating device such that the temperature of the object in the inlet port of the drying chamber is lower by a predetermined temperature difference than the temperature of the vapor atmosphere therein, based on the detected results obtained by the temperature detecting device.

6. The drying apparatus for drying an object according to claim 5 further comprising a cooling device to cool the object at a prestage of the drying chamber, wherein the control device controls the cooling device such that the temperature of the object in the inlet port of the drying chamber is lower by a predetermined temperature difference than the temperature of the vapor atmosphere, based on the detected results obtained by the temperature detecting device.

7. The drying apparatus for drying an object according to claim 5 further comprising:

a vapor amount detecting device to detect a vapor amount of the second solvent in the drying chamber; and a vapor amount controlling device to control a vapor amount of the second solvent supplied to the drying chamber such that the vapor amount of the second solvent in the drying chamber is in a predetermined range, based on the detected result obtained by the vapor amount detecting device.

8. The drying apparatus for drying an object according to claim 5 further comprising an air curtain forming device to form an air curtain in the inlet port and an outlet port of the drying chamber.

9. The drying apparatus for drying an object according to claim 5 further comprising:

a solvent storing tank to store the second solvent to be supplied to the solvent vapor generating device;

a separating device to separate the second solvent from a vapor atmosphere exhausted from the drying chamber; and a circulating pipe to return the second solvent separated in the separating device to the solvent storing tank.

10. An apparatus for manufacturing a lithographic printing plate precursor, wherein the apparatus comprises the drying apparatus for drying an object according to claim 5.

11. A drying method for drying an object containing a first solvent while the object is conveyed, -comprising:

a first drying step of drying the object up to a drying point; and a second drying step of forming, in a drying chamber at a post stage of the first drying step, a vapor atmosphere of a second solvent having a lower boiling point than the first solvent and drying the object such that a temperature of the object in an inlet port of the drying chamber is made to be lower by a predetermined temperature difference than a temperature of the vapor atmosphere, wherein the temperature difference is in a range of 5° C. to 100° C., wherein $$0.25 \leqq CR(273.15+T)/(P_T \times M) < 1.0$$

is satisfied where a vapor amount of the second solvent is denoted as C [g/m$^3$]; a temperature of the object is denoted as T [° C.]; a saturated vapor pressure of the second solvent at T° C. is denoted as $P_T$ [Pa]; the molecular weight of the second solvent is denoted as M; and the gas constant is denoted as R (8.31 Pa·m$^3$/(mol·K)).

12. The drying method for drying an object according to claim 11 further comprising:

a temperature detecting step of detecting a temperature of the vapor atmosphere of the second solvent and a temperature of the object; and a temperature controlling step of controlling the temperature of the object and/or the temperature of the vapor atmosphere of the second solvent such that the temperature of the object is lower by a predetermined temperature difference than the temperature of the vapor atmosphere, based on the detected results obtained by the temperature detecting step.

13. The drying method for drying an object according to claim 11 further comprising:

a vapor amount detecting step of detecting a vapor amount of the second solvent in the drying chamber to form the vapor atmosphere of the second solvent; and a vapor amount controlling step of controlling the vapor amount of the second solvent supplied to the drying chamber such that the vapor amount of the second solvent in the drying chamber is in a predetermined range, based on the detected result obtained by the vapor amount detecting step.

14. A method for manufacturing a lithographic printing plate precursor, wherein the drying method of an object according to claim 11 is applied to the manufacturing method.

15. The drying apparatus for drying an object according to claim 6 further comprising:

a vapor amount detecting device to detect a vapor amount of the second solvent in the drying chamber; and a vapor amount controlling device to control a vapor amount of the second solvent supplied to the drying chamber such that the vapor amount of the second solvent in the drying chamber is in a predetermined range, based on the detected result obtained by the vapor amount detecting device.

16. The drying apparatus for drying an object according to claim 6 further comprising an air curtain forming device to form an air curtain in the inlet port and an outlet port of the drying chamber.

17. The drying apparatus for drying an object according to claim 6 further comprising:

a solvent storing tank to store the second solvent to be supplied to the solvent vapor generating device;

a separating device to separate the second solvent from a vapor atmosphere exhausted from the drying chamber; and a circulating pipe to return the second solvent separated in the separating device to the solvent storing tank.

18. A drying apparatus for drying an object containing a first solvent while the object is conveyed, comprising:

a first drying section to dry the object up to a drying point; and a second drying section to form a vapor atmosphere of a second solvent having a lower boiling point than the first solvent in a drying chamber provided at a post stage of the first drying section and to dry the object such that a temperature of the object in an inlet port of the drying chamber is made to be lower by a predetermined temperature difference than a temperature of the vapor atmosphere, wherein the second drying section comprises:

a solvent vapor generating device to generate a second solvent having a lower boiling point than the first solvent and to form a vapor atmosphere of the second solvent in the drying chamber;

a heating device to heat the object in the drying chamber;

a temperature detecting device to detect a temperature of the vapor atmosphere of the second solvent and a temperature of the object in an inlet port of the drying chamber; and a controlling device to control the heating device such that the temperature of the object in the inlet port of the drying chamber is lower by a predetermined temperature difference than the temperature of the vapor atmosphere therein, based on the detected results obtained by the temperature detecting device; and further comprising a third drying section to dry by hot air the object at a post stage of the second drying section.

* * * * *